US006412126B2

(12) United States Patent
Heimbrock et al.

(10) Patent No.: US 6,412,126 B2
(45) Date of Patent: Jul. 2, 2002

(54) OB/GYN STRETCHER

(75) Inventors: Richard H. Heimbrock, Cincinnati, OH (US); Jonathan D. Turner, Dillsboro, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/780,803

(22) Filed: Feb. 9, 2001

Related U.S. Application Data

(63) Continuation of application No. 09/131,080, filed on Aug. 7, 1998, now Pat. No. 6,282,738.

(51) Int. Cl.[7] ..... A61G 7/015; A61G 7/002

(52) U.S. Cl. ..... 5/618; 5/613; 5/602; 5/600

(58) Field of Search ..... 5/600, 602, 613, 5/614, 616, 617, 618, 619, 624

(56) References Cited

U.S. PATENT DOCUMENTS

| | | | | |
|---|---|---|---|---|
| 2,021,107 | A | 11/1935 | Logie | 5/602 |
| 2,120,732 | A | 6/1938 | Comper et al. | 5/602 |
| 2,257,491 | A | 9/1941 | Armstrong | 5/602 |
| 2,290,191 | A | 7/1942 | Karlson | 5/602 |

(List continued on next page.)

FOREIGN PATENT DOCUMENTS

| | | | |
|---|---|---|---|
| DE | 297 02 889 | 2/1997 | |
| DE | 196 04 549 | 8/1997 | |
| DE | 298 00 015 | 3/1998 | |
| DE | 0298 00 015 | 3/1998 | |
| EP | 150254 | 8/1985 | 5/600 |
| EP | 0 604 240 | 6/1994 | |
| EP | 0 839 508 A1 | 5/1998 | |
| EP | 0 845 254 | 6/1998 | |
| FR | 636085 | 3/1928 | |
| FR | 1456058 | 10/1966 | |
| FR | 1566571 | 5/1969 | |
| FR | 2061319 | 6/1971 | |
| GB | 497662 | 12/1938 | |
| GB | 1389344 | 4/1975 | |
| GB | 2041737 | 9/1980 | 5/602 |
| JP | 58-81032 | 5/1983 | |
| RU | 381350 | 5/1973 | 5/618 |
| WO | 92-18082 | 10/1992 | |
| WO | 92-18083 | 10/1992 | |
| WO | 93-09750 | 5/1993 | |
| WO | 99-23991 | 5/1999 | |

OTHER PUBLICATIONS

Hill–Rom, Inc., "The Affinity Bed From Hill–Rom", 1992, 12 pages.

Stryker Adel, "2100EC Childbearing Bed, Ultimate convenience and comfort", Jan. 1994, 6 pages.

Stryker Adel, "500XL Childbearing Bed", May 1995, 2 pages.

Stryker Adel, "2100 Childbearing Bed, Service Manual", 1988, pp. 1–28.

Stryker Adel, "500XL Childbearing Bed, Service Manual", 1986, pp. 1–16.

*Primary Examiner*—Robert G. Santos
(74) *Attorney, Agent, or Firm*—Barnes & Thornburg

(57) ABSTRACT

A patient support apparatus includes a base, a frame coupled to the base, and a deck coupled to the frame. The frame includes a storage portion. The deck includes a head section, a seat section and first and second laterally spaced apart outer leg support sections adjacent the seat section. The seat section and the first and second outer leg support sections being configured to define a central opening therebetween. The apparatus also includes a removable center leg support configured for movement between a first position located within the central opening and coupled to the deck to provide a portion of the deck and a second storage position detached from the deck and located in the storage portion of the frame and below the deck.

20 Claims, 16 Drawing Sheets

U.S. PATENT DOCUMENTS

| | | | | | |
|---|---|---|---|---|---|
| 2,306,031 | A | | 12/1942 | Anderson et al. | 5/602 |
| 2,605,151 | A | | 7/1952 | Shampaine | 5/602 |
| 2,832,655 | A | | 4/1958 | Adolphson | 5/602 |
| 3,041,120 | A | | 6/1962 | Burzlaff et al. | 5/614 |
| 3,041,121 | A | | 6/1962 | Comper | 5/618 |
| 3,041,122 | A | | 6/1962 | Weickgenannt et al. | 5/614 |
| 3,226,105 | A | | 12/1965 | Weickgenannt et al. | 5/624 |
| 3,281,141 | A | | 10/1966 | Smiley et al. | 5/614 |
| 3,318,596 | A | | 5/1967 | Herzog | 5/619 |
| 3,334,951 | A | | 8/1967 | Douglass, Jr. et al. | 312/209 |
| 3,411,766 | A | | 11/1968 | Lanigan | 5/619 |
| 3,486,747 | A | | 12/1969 | Cardoso | 5/619 |
| 3,599,963 | A | | 8/1971 | Grover | 5/618 |
| 3,686,696 | A | * | 8/1972 | Lanigan | 5/611 |
| 3,733,481 | A | | 5/1973 | Kuyt | 362/580 |
| 3,845,945 | A | | 11/1974 | Lawley et al. | 5/602 |
| 3,851,870 | A | | 12/1974 | Cook | 5/618 |
| 4,034,972 | A | | 7/1977 | Peterson | 5/618 |
| 4,057,240 | A | | 11/1977 | Damico et al. | 5/611 |
| 4,139,917 | A | | 2/1979 | Fenwick | 5/602 |
| 4,227,269 | A | | 10/1980 | Johnston | 5/611 |
| 4,247,091 | A | | 1/1981 | Glowacki | 5/602 |
| 4,356,578 | A | | 11/1982 | Clark | 5/602 |
| 4,411,035 | A | | 10/1983 | Fenwick | 5/602 |
| 4,426,071 | A | | 1/1984 | Klevstad | 5/602 |
| 4,615,058 | A | | 10/1986 | Feldt | 5/602 |
| 4,639,954 | A | | 2/1987 | Speed | 5/602 |
| 4,682,376 | A | | 7/1987 | Feldt | 5/602 |
| 4,751,754 | A | | 6/1988 | Bailey et al. | 5/611 |
| 4,805,249 | A | | 2/1989 | Usman et al. | 5/619 |
| 4,821,350 | A | | 4/1989 | Feldt | 5/602 |
| 4,894,876 | A | | 1/1990 | Fenwick | 5/602 |
| 5,060,327 | A | | 10/1991 | Celestina et al. | 5/662 |
| 5,081,729 | A | | 1/1992 | Menady | 5/487 |
| 5,129,117 | A | | 7/1992 | Celestina et al. | 5/602 |
| 5,157,800 | A | | 10/1992 | Borders | 5/602 |
| 5,161,274 | A | | 11/1992 | Hayes et al. | 5/618 |
| 5,197,156 | A | | 3/1993 | Stryker et al. | 5/428 |
| 5,205,004 | A | | 4/1993 | Hayes et al. | 5/611 |
| 5,214,812 | A | | 6/1993 | Bartow et al. | 5/624 |
| 5,226,187 | A | | 7/1993 | Borders et al. | 5/602 |
| 5,331,698 | A | | 7/1994 | Newkirk et al. | 5/602 |
| 5,377,373 | A | | 1/1995 | Shirai | 5/613 |
| 5,454,126 | A | | 10/1995 | Foster et al. | 5/618 |
| 5,479,666 | A | * | 1/1996 | Foster et al. | 5/624 |
| 5,522,098 | A | | 6/1996 | Podgorschek | 5/602 |
| 5,555,582 | A | | 9/1996 | Jerideau | 5/600 |
| 5,577,279 | A | * | 11/1996 | Foster et al. | 5/618 |
| 5,636,394 | A | | 6/1997 | Bartley | 5/611 |
| 5,708,997 | A | * | 1/1998 | Foster et al. | 5/618 |
| 5,774,914 | A | | 7/1998 | Johnson et al. | 5/602 |
| 5,806,114 | A | | 9/1998 | Morgan et al. | 5/604 |
| 5,933,888 | A | * | 8/1999 | Foster et al. | 5/604 |
| 6,112,345 | A | * | 9/2000 | Foster et al. | 5/81.1 R |
| 6,226,821 | B1 | * | 5/2001 | Heimbrock et al. | 5/602 X |
| 6,282,738 | B1 | * | 9/2001 | Heimbrock et al. | 5/618 |

* cited by examiner

OB/GYN STRETCHER

This is a continuation application of a U.S. patent application, Ser. No. 09/131,080, filed on Aug. 7, 1998, and entitled "OB/GYN STRETCHER" now U.S. Pat. No. 6,282,738.

BACKGROUND AND SUMMARY OF THE INVENTION

The present invention relates to medical stretchers, and particularly to stretchers used for patients requiring treatment or examination of the pelvic region, such as during labor and delivery or during gynecological examinations. More particularly, the present invention relates to stretchers convertible between a conventional stretcher configuration that supports the patient in a recumbent position and an Ob/Gyn configuration that supports the patient in a parturition or lithotomy position while providing medical caregivers improved patient access.

Hospital emergency rooms and maternity units often receive patients that require handling in both a recumbent position and in a parturition or lithotomy position. For example, a maternity patient will typically remain in a recumbent position during labor, with her legs resting on a mattress surface, and then assume a parturition or lithotomy position to facilitate childbirth. During labor there often is also a need for the medical caregiver, such as a nurse or doctor, to have access to the patient's pelvic region, for example to assess cervical dilatation, after which time the patient again assumes a recumbent position. Patients and care givers thus benefit from medical stretchers that both allows the patient to lie in a conventional, recumbent position and that convert to a configuration to support the patient in a parturition or lithotomy position while simultaneously providing the care giver with improved access to the patient's pelvic region.

According to one aspect of the present invention, a patient support apparatus includes a base, a frame coupled to the base, and a deck coupled to the frame. The frame includes a storage portion. The deck includes a head section, a seat section and first and second laterally spaced apart outer leg support sections adjacent the seat section. The seat section and the first and second outer leg support sections being configured to define a central opening therebetween. The apparatus also includes a removable center leg support configured for movement between a first position located within the central opening and coupled to the deck to provide a portion of the deck and a second storage position detached from the deck and located in the storage portion of the frame and below the deck.

The illustrated embodiment includes a latch coupled to the center leg support to secure the center leg support to the deck in the first position. The illustrated latch includes a pin coupled to the center leg support. The pin is configured to enter a pin-receiving receptacle formed in the deck. The center leg support also includes an actuator coupled to the latch. The actuator is configured to move the latch between a latched position to lock the center leg support in the first position and an unlatched position. The illustrated actuator includes a cable assembly having a first end coupled to the latch and a second end coupled to a handle. The center leg support includes a bottom surface formed to include a recess configured to receive at least a portion of the cable assembly.

The illustrated apparatus also includes at least one pivot block coupled to the frame. The pivot block is configured to support the center leg support in the first position. The pivot block includes a pin and the center leg support includes a pin-receiving receptacle configured to engage the pin when the center leg support is in the first position. The pin-receiving receptacle is illustratively formed by a bar coupled to a bottom surface of the center leg support.

The center leg support includes a bottom having a support surface and at least one guide surface cooperating with the at least one pivot block to align and hold the center leg support in the first position. Illustratively, at least one ramp surface is located adjacent the support surface to facilitate movement of the center leg support onto the at least one pivot block.

The illustrated embodiment includes first and second pivot blocks coupled to the frame. The center leg support includes a bottom support surface configured to engage the pivot blocks and hold the center leg support in the first position. The center leg support further includes first and second spaced apart guides located adjacent the bottom support surface. The guides are configured to position the center leg support relative to the first and second pivot blocks. The first and second pivot blocks each include a pin and the center leg support includes a pin-receiving receptacle configured to engage the pins when the center leg support is in the first position.

The illustrated center leg support includes a first latch coupled to a first side portion of the center leg support and a second latch coupled to a second side portion of the center leg support. The first and second latches are configured to couple the center leg support section to the deck adjacent the first and second outer leg support sections, respectively. A single actuator is coupled to the first and second latches for selectively latching and unlatching both the first and second latches.

The illustrated embodiment also includes a siderail coupled to the frame. The siderail is formed to include a grip portion. The siderail illustratively includes a plurality of support bars pivotably coupled to the frame. At least one of the support bars is configured to define the grip portion. The illustrated grip portion is padded and located adjacent a foot end of the frame.

According to another aspect of the present invention, a patient support apparatus includes a base, a frame coupled to the base, and a deck coupled to the frame. The frame includes a first open channel and a second closed channel. The first and second channels are spaced apart and extend long a longitudinal axis of the frame. The deck is configured to support a patient. The apparatus also includes first and second rollers coupled to the deck. The first roller is located in the first open channel and the second roller being located in the second closed channel to permit longitudinal movement of the deck relative to the frame.

The apparatus further includes a latch coupled between the deck and the frame. The latch is movable between a latched position to prevent movement of the deck relative to the frame in an unlatched position to allow longitudinal movement of the deck relative to the frame. The illustrated latch is movable to a first latched position when the deck is in a first position relative to the frame. The latch also is movable to the second latched position when the deck is moved to a second position relative to the frame.

According to yet another aspect of the present invention, a mattress includes a head section, a seat section, and first and second outer leg support sections. The seat section and the first and second outer leg support sections are configured to define a central opening therebetween. The apparatus also includes a drip flap coupled to the seat section and first and second outer leg support sections. The drip flap is configured to extend downwardly below a bottom surface of the mattress adjacent the central opening of the mattress.

The illustrated first and second outer leg sections each include a heel cut-out portion. The apparatus also includes first and second flexible portions coupled between the seat section and the first and second outer leg support sections, respectively, to permit relative movement between the first and second outer leg sections and the seat section of the mattress.

The head section, seat section, and first and second outer leg support sections are illustratively made from a first foam material, and the flexible portions are illustratively made from a second foam material. The second foam material has a density less than the first foam material.

The illustrated apparatus further includes first and second foot straps coupled to the first and second outer leg support sections of the mattress, respectively. The illustrated apparatus further includes at least one fastener coupled to a bottom surface of the mattress to facilitate attachment of the mattress to a support surface.

The illustrated drip flap extends further downwardly below the bottom surface of the mattress adjacent the first and second outer leg support sections than adjacent the seat section. The illustrated apparatus also includes at least one bevel cut segment extending between a top surface and a bottom surface of the mattress. The first and second outer leg support sections are formed to include bevel cuts to facilitate access to a control handle when the mattress is positioned on a frame of a patient support surface.

According to a further aspect of the present invention, a patient support apparatus includes a base, a frame coupled to the base, and a deck coupled to the frame. The frame has a head end and a foot end. The deck is movable relative to the frame along a longitudinal axis of the frame toward the foot end of the frame. The apparatus also includes a latch coupled between the deck and the frame. The latch is movable between a latched position to prevent movement of the deck relative to the frame and an unlatched position to allow longitudinal movement of the deck relative to the frame. The apparatus further includes an actuator coupled to the latch to move the latch between the latched and unlatched positions. The actuator is coupled to the deck adjacent a foot end portion of the deck for access by a caregiver while moving the deck toward the foot end of the frame.

The illustrated latch includes a pin coupled to the deck which is configured to enter a receptacle formed in the frame. The illustrated deck includes a head section, a seat section and first and second laterally spaced outer leg support sections adjacent the seat section. The actuator is coupled to one of the first and second outer leg support sections. The illustrated actuator is coupled to a foot end of the first outer leg support section.

In the illustrated apparatus, the latch includes first and second latches. Each of the first and second latches is movable between a latched position to prevent movement of the deck relative to the frame and an unlatched position to allow longitudinal movement of the deck relative to the frame. The illustrated actuator includes a first actuator coupled to the first latch to move the first latch between the latched and unlatched positions and a second actuator coupled to second latch to move the second latch between the latched and unlatched positions. The first and second actuators are both located adjacent the foot end portion of the deck and illustratively are coupled to the first outer leg section and the second outer leg section, respectively. In this embodiment, the first and second actuators must both be actuated to release the deck from the frame.

The illustrated embodiment also includes a siderail pivotably coupled to the frame by first and second swing arms, and a cam surface coupled to the deck. The cam surface is configured to engage the first swing arm as the deck moves relative to the frame to pivot the siderail outwardly relative to the frame.

According to a still further aspect of the present invention, a patient support apparatus includes a base, a frame coupled to the base, and a deck coupled to the frame to support the patient. The deck includes a support surface pivotably coupled to the deck by a linkage. The apparatus also includes an actuator coupled to the linkage to selectively lock and unlock the linkage to permit adjustment of the orientation of the support surface, and a covering configured to surround at least a portion of the support surface and the linkage to facilitate cleaning of the linkage.

The illustrated deck includes a head section, a seat section, and first and second laterally spaced outer leg support sections coupled to the seat section by first and second linkages, respectively. The seat section and the first and second outer leg support sections are configured to define a central opening therebetween. First and second coverings are configured to surround at least a portion of the first and second outer leg support sections and the first and second linkages, respectively.

The illustrated covering includes a bellows portion located over the linkage to permit movement of the linkage. The illustrated covering also surrounds the actuator and is formed from a flexible, elastomeric material.

According to an additional aspect of the present invention, a patient support apparatus includes a base, a frame coupled to the base, and a deck configured to support the patient. The frame is formed to include a first receptacle, and the deck is formed to include a second receptacle. The apparatus also includes a removable calf support having a mounting portion configured to be located in the first receptacle to store the removable calf support beneath the deck. The mounting portion is configured to be located in the second receptacle to support a patient's leg above the deck.

The illustrated mounting portion of the calf support is configured to extend in a direction generally parallel to a longitudinal axis of the frame when the removable calf support is located in the first receptacle. The mounting portion of the removable calf support is configured to extend in a direction generally perpendicular to the longitudinal axis of the frame when the removable calf support is in the second receptacle. The illustrated calf support includes a calf support surface coupled to the mounting portion by an adjustable linkage.

According to another aspect of the present invention, a patient support apparatus includes a base, a plurality of casters coupled to the base, a frame coupled to the base, and a deck coupled to the frame. The deck is configured to support the patient. The deck includes a head section, a seat section and first and second laterally spaced apart outer leg support sections adjacent the seat section. The seat section and the first and second outer leg support sections are configured to define a central opening therebetween. The apparatus also includes a lighting system having a light source coupled to one of the base, the frame, and the deck spaced apart from the central opening of the deck. The lighting system also includes a light head coupled to the light source. The light head is located adjacent the central opening of the deck to permit examination of the patient located on the deck.

The illustrated light head is positioned adjacent a foot end of the deck. The illustrated lighting system includes a fiber optic connection between the light source and the light head. A flexible connector is coupled to the light head to hold the light head in a desired position relative to the deck. The illustrated flexible connector is configured to be received within a receptacle formed in the frame. The illustrated lighting system includes a power cord coupled to the light source. The power cord is configured to be coupled to a power outlet to supply power to the light source. The illustrated apparatus further includes a clip coupled to one of the base, frame and deck. The clip is configured to hold the light head in a storage position.

According to a further aspect of the present invention, a patient support apparatus includes a base, a frame coupled to the base, and a deck coupled to the frame. The frame includes first and second channels which are spaced apart and configured to extend along a longitudinal axis of the frame. The deck is configured to support the patient. The apparatus also includes first and second lifting mechanisms coupled to the base. The first lifting mechanism is pivotably coupled to the frame. The apparatus further includes a coupler coupled to the second lifting mechanism. The coupler includes first and second rollers located in the first and second channels of the frame, respectively, to couple the second lifting mechanism to the frame, thereby permitting movement of the coupler and the second lifting mechanism relative to the frame.

The illustrated coupler includes a bar coupled to a top end of the second lifting mechanism and extending generally transverse to the longitudinal axis of the frame. The first roller is coupled to a first end of the bar, and the second roller is coupled to a second end of the bar. The first and second rollers are configured to move toward an end of the frame away from the first lifting mechanism when the first and second lifting mechanisms are adjusted to different heights relative to each other. Illustratively, the first channel is an open channel and the second channel is a closed channel.

According to a further aspect of the present invention, a patient support apparatus includes a base, a frame coupled to the base, and a deck coupled to the frame to support the patient. The deck is movable relative to the frame along a longitudinal axis of the frame. The deck includes support surface pivotably coupled to the deck by a linkage. The apparatus also includes a latch coupled between the deck and the frame. The latch is movable between a latched position to prevent movement of the deck relative to the frame and an unlatched position to allow longitudinal movement of the deck relative to the frame. The apparatus further includes a locking mechanism coupled to the support surface to hold the support surface in a selected position relative to the deck, and an actuator coupled to the locking mechanism to selectively release the locking mechanism. The actuator also is coupled to the latch to move the latch between the latched and unlatched positions so that when the actuator is actuated, the latch is unlatched to permit movement of the deck relative to the frame and the locking mechanism is released to permit movement of the support surface relative to the deck.

In the illustrated embodiment, the actuator is located adjacent a foot end of the deck on the support surface. The illustrated support surface is a leg support surface, and the actuator is located adjacent a foot end of the leg support surface. The illustrative actuator includes a first cable having a first end coupled to the latch and a second end coupled to a handle of the actuator and a second cable having a first end coupled to the locking mechanism and a second end coupled to the handle of the actuator.

According to a further aspect of the present invention, a patient support apparatus includes a base, a frame coupled to the base, and a deck coupled to the frame. The deck is movable relative to the frame along a longitudinal axis of the frame. The deck includes a head section, a seat section and first and second laterally spaced apart outer leg support sections adjacent the seat section. The first and second outer leg support sections are pivotable relative to the seat section of the deck. The apparatus also includes a latch coupled between the deck and the frame. The latch is movable between a latched position to prevent movement of the deck relative to the frame and an unlatched position to allow longitudinal movement of the deck relative to the frame. The apparatus further includes first and second locking mechanisms coupled to the first and second outer leg support sections, respectively, to hold the first and second outer leg support sections in selected positions relative to the seat section, and first and second actuators located on the first and second outer leg support sections, respectively. The first and second actuators are coupled to the first and second locking mechanisms, respectively. The first and second actuators are configured to release the first and second locking mechanisms and allow pivotable movement of the first and second outer leg support sections. The first actuator is also coupled to the latch to move the latch between the latched and unlatched positions.

In the illustrated embodiment, the first and second actuators are coupled to a foot end of the first and second outer leg support sections, respectively. The illustrative latch includes first and second latches, each of the first and second latches being movable between a latched position to prevent movement of the deck relative to the frame and an unlatched position to allow longitudinal movement of the deck relative to the frame. The first actuator is coupled to the first latch to move the first latch between the latched and unlatched positions. The second actuator is coupled to second latch to move the second latch between the latched and unlatched positions. The first and second actuators must both be actuated to release the deck from the frame.

According to a further aspect of the present invention, a patient support apparatus includes a base, a frame coupled to the base, and a deck coupled to the frame. The deck includes a head section, a seat section, and first and second laterally spaced apart outer leg support sections. The first and second outer leg support sections are each pivotably coupled to the seat section about a first and second pivot axes, the first pivot axis being transverse to the second pivot axis. The apparatus also includes first and second locking mechanisms coupled to each outer leg support section. The first and second locking mechanisms are configured to prevent movement of the outer leg support sections about the first and second pivot axes, respectively, to hold the outer leg support sections in selected positions relative to the seat section. The apparatus further includes first and second actuators located adjacent a foot end of each of the outer leg support sections. The first and second actuators are coupled to the first and second locking mechanisms, respectively, to selectively release the first and second locking mechanisms and allow pivotable movement of the outer leg support sections about the first and second pivot axes.

In the illustrated embodiment, the first locking mechanism includes a mechanical lock having a cylinder pivotably coupled to the seat section, a movable rod pivotably coupled to the outer leg support section, and a release mechanism for selectively permitting movement of the rod relative to the cylinder to allow pivoting movement of the outer leg support section about the first pivot axis. The first actuator is coupled to the release mechanism. The second locking mechanism includes a piston and cylinder having first and second ends pivotably coupled to the outer leg support section. The piston is selectively releasable to permit pivoting movement of the outer leg support section about the second pivot axis. The second actuator is coupled to the piston and cylinder arrangement to selectively release the piston.

According to a still further aspect of the present invention, a patient support apparatus includes a base, a frame coupled to the base, and a deck coupled to the frame. The deck is movable relative to the frame along a longitudinal axis of the frame. The deck include a head section, a seat section, and first and second laterally spaced apart outer leg support sections adjacent the seat section. The seat section and the first and second outer leg support sections are configured to define a central opening therebetween. The first and second outer leg support sections are pivotable relative to the seat section of the deck. The apparatus also includes a center leg support configured for movement between a first position located within the central opening to provide a portion of the deck and a second storage position, a first latch coupled between the deck and the frame, and a second latch coupled to the center leg support. The first latch is movable between a latched position to prevent movement of the deck relative to the frame and an unlatched position to allow longitudinal movement of the deck relative to the frame, and the second latch being movable between a latched position to lock the center leg support in the first position and an unlatched position. The apparatus further includes first and second locking mechanisms coupled to the first and second outer leg support sections, respectively, to hold the first and second outer leg support sections in selected positions relative to the seat section of the deck, and a plurality of actuators located adjacent a foot end of the deck for access to a caregiver located at the foot end of the deck. The plurality of actuators are configured to move the first and second latches between the latched and unlatched positions and to release the first and second locking mechanisms and allow pivotable movement of the first and second outer leg support sections.

In the illustrated embodiment, the first and second locking mechanisms are each configured to prevent movement of the outer leg support sections about first and second pivot axes to hold the outer leg support sections in selected positions relative to the seat section. The plurality of actuators includes first and second actuators located adjacent a foot end of each of the outer leg support sections. The first and second actuators are configured to release the first and second locking mechanisms and allow pivotable movement of the outer leg support sections about the first and second pivot axes, respectively.

Additional features of the invention will become apparent to those skilled in the art upon consideration of the following detailed description of the presently perceived best mode of carrying out the invention.

BRIEF DESCRIPTION OF THE DRAWINGS

The detailed description particularly refers to the accompanying figures in which.

DETAILED DESCRIPTION OF DRAWINGS

Figure 3:
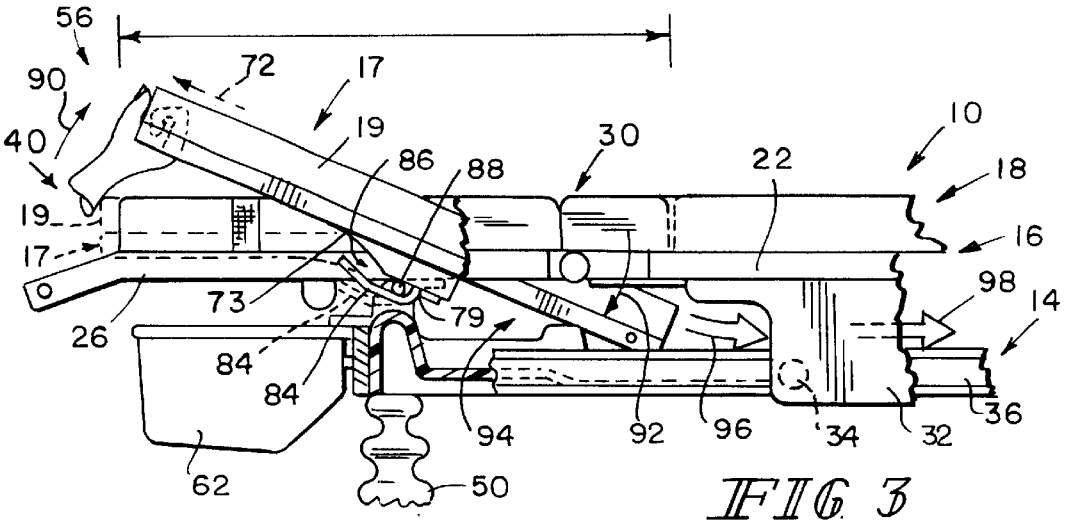
FIG. 3 is a side elevation view of the foot end portion of the stretcher of FIG. 1, with a portion broken away to show the movable central leg section in an intermediate position during movement to the stowed position.
Figure 4:
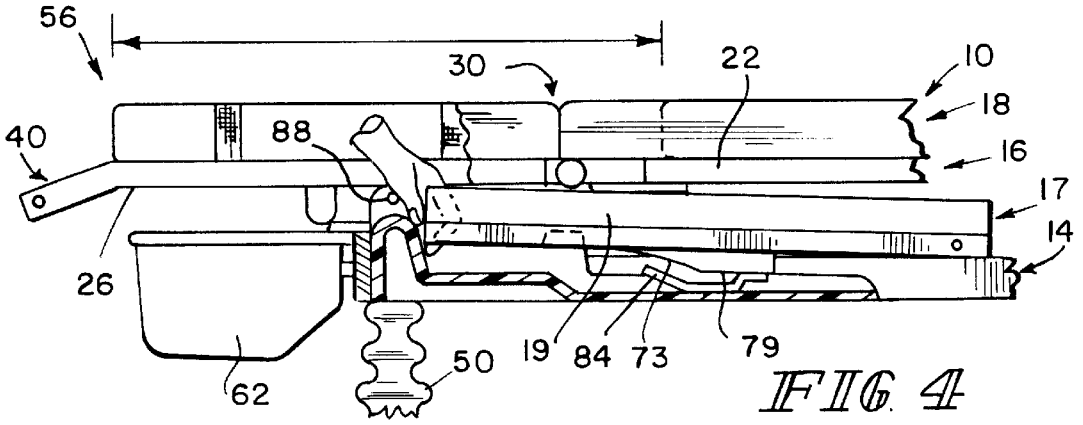
FIG. 4 is side elevation view of the foot end portion of the stretcher of FIG. 1, with a portion broken away to show the movable central leg section moved to the stowed position.

Although the specification of this application discusses the present invention in terms of a stretcher, the features have applicability in other patient support apparatus such as beds, tables, etc. A stretcher 10 according to the present invention includes a base 12, a frame 14, a deck 16, and a mattress 18, as shown for example in FIG. 1. Stretcher 10 further includes a movable center leg support 17 that selectively can be coupled to deck 16 as shown for example in FIGS. 1–2 or stowed beneath deck 16 as shown in FIGS. 3–4. Deck 16, leg support 17, and mattress 18 are configured to allow stretcher 10 to convert between a conventional stretcher configuration and an Ob/Gyn configuration in which a medical caregiver is provided with improved access to a patient's pelvic region.

Deck 16 includes a head section 20, a seat section 22, and left and right outer leg sections 24, 26. Seat section 22 and outer leg sections 24, 26 define between them an opening 15 configured to receive center leg support 17. Head section 20 is pivotably coupled to seat section 22 by a pivot 28 and outer leg sections 24, 26 are each pivotably coupled to seat section 22 by hinge assemblies 30 that provide for rotation about two axes. Head section 20 can thus be rotated vertically with respect to seat section 22, as shown for example in FIG. 1 to elevate a patient's head. Outer leg sections 24, 26 can be rotated both horizontally and vertically with respect to seat section 22, as shown for example in FIG. 8.

As discussed in more detail below, deck 16 is coupled for longitudinal movement with respect to frame 14. Briefly, deck 16 includes two downwardly extending lateral carriage plates 32 and two or three rollers 34 coupled to each plate 32. Frame 14 includes two laterally spaced, longitudinally extending channels 36, 38 configured to receive rollers 34. A deck release mechanism 40 allows for selectively latching or unlatching frame 14 to deck 16 to enable or prevent relative longitudinal movement relative to deck 16. Deck 16 further includes a pair of gas/cylinders 42 coupled between carriage plates 32 and deck head section 20 to allow for selectively adjusting an angle between head section 20 and seat section 22 around pivot 28 through use of a release handle 44 coupled to the piston of cylinder 42.

Figure 14:
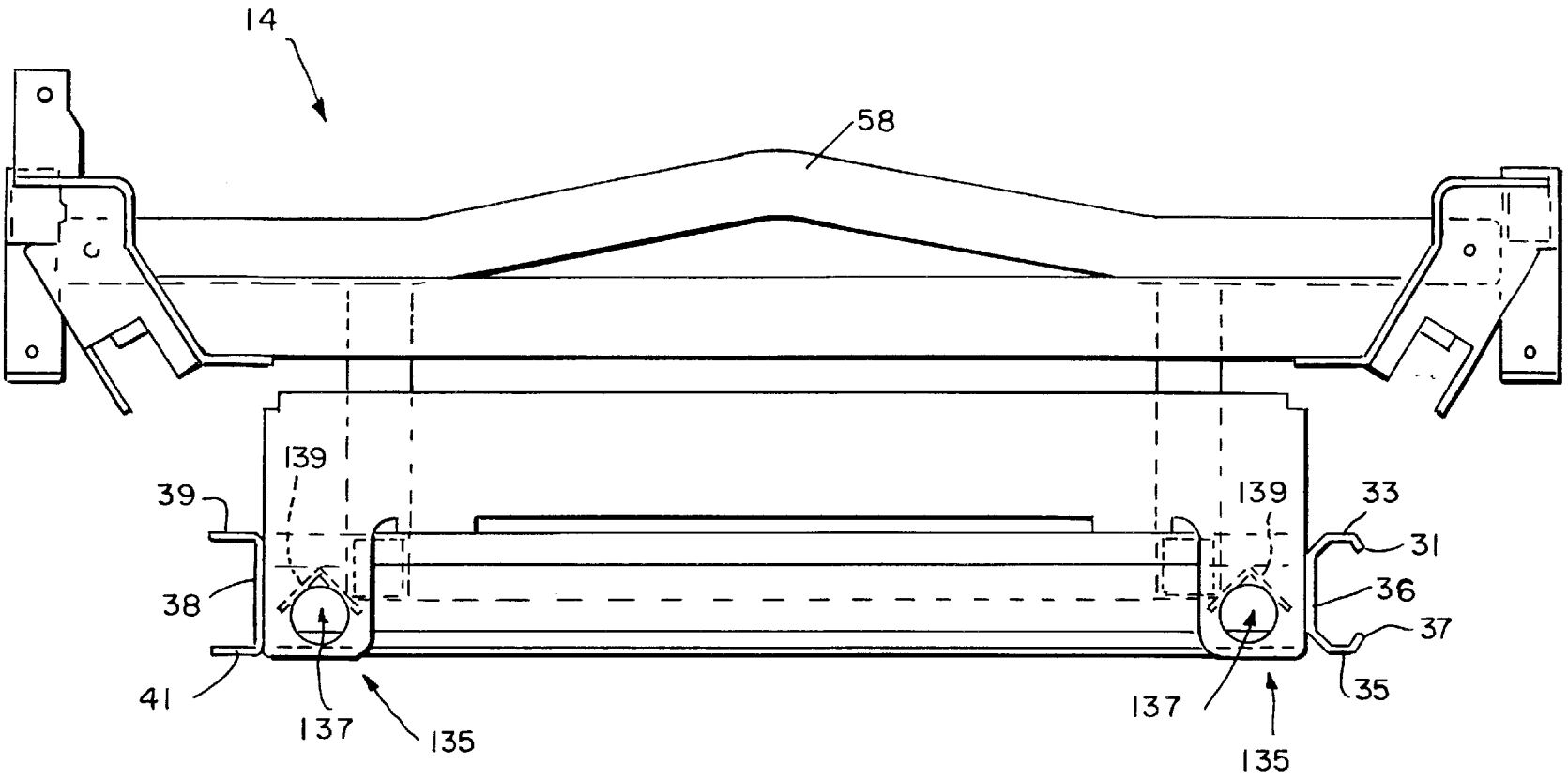
FIG. 14 is an end view of the stretcher frame of FIG. 1, showing open and closed channels for receiving rollers from the deck and circular openings for stowing removable calf supports.

Channel 36 includes top and bottom flanges 33, 35 configured to retain rollers 34 against lateral movement as shown in FIG. 14. Top flange 33 has a downwardly extending lip 31 and bottom flange 35 has an upwardly extending lip 37 to provide channel 36 with a generally C-shaped or closed profile. Channel 38 includes flat top and bottom flanges 39, 41 to provide an open profile that allows for lateral movement of rollers 34 within channel 38. The complementary open and closed profiles of channels 36, 38 reduces the tendency of rollers 34 to bind while deck 16 moves longitudinally with respect to frame 14.

Base 12 includes four casters 46 and is coupled to frame 14 by hydraulic lifting mechanisms or supports 48, 50. Base 12 further includes foot pedals 52 for selectively raising or lowering either or both supports 48, 50 so that stretcher 10 can be placed in a variety of orientations such as a Trendelenburg or reverse Trendelenburg position. Stretcher 10 has a head end 54 and a foot end 56 and includes a catch basin 62 coupled to frame 14 at foot end 56, a combination bumper and push handle 58 at head end 54, and a siderail assembly 60.

Figure 22:
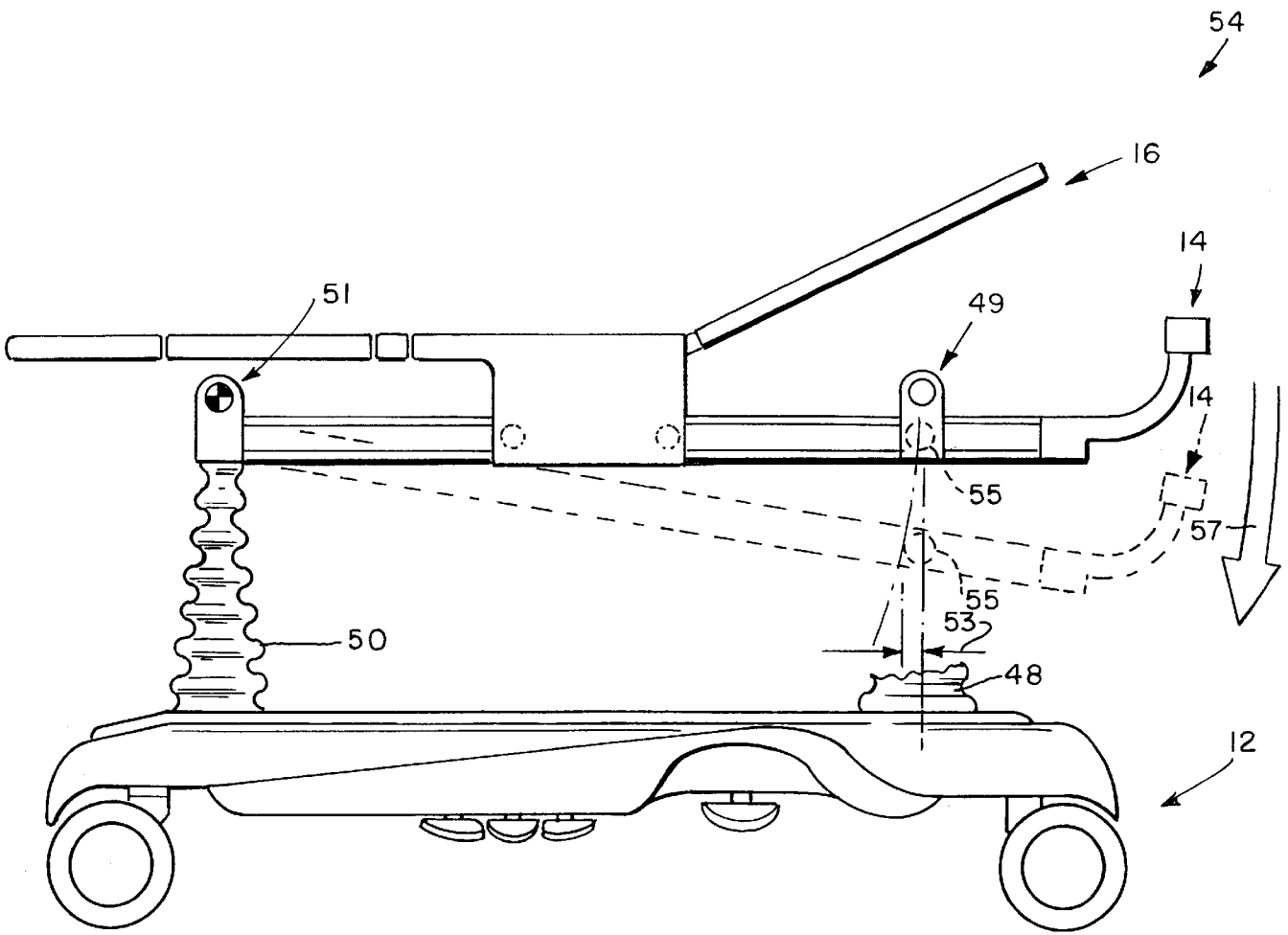
FIG. 22 is a side elevation of a stretcher, showing a base, a frame, a deck, vertically adjustable head and foot end supports coupled between the base and frame, and a roller assembly coupled between the frame and the head end support to allow for tilting of the frame relative to the base.

Channels 36, 38 are further used to facilitate tilting of frame 14 relative to base 12 as best shown in FIG. 22. Head end lifting support 48 is slidably coupled to frame 14 by a roller coupling assembly 49 fixed to head end support 48. Roller coupling assembly 49. includes a bar 47 (see FIG. 15) coupled to a top end of the support 48 and rollers 55 coupled to opposite ends of the bar 47. The rollers 55 are located in each channel 36, 38. Foot end support 50 is coupled to frame 14 by a pivot assembly 51. Frame 14 is raised, lowered and tilted relative to base 12 by moving supports 48, 50 vertically up and down. When frame 14 is tilted to a Trendelenburg position (dotted position) as shown by arrow 57, the distance between rollers 55 and pivot assembly 51 increases by a distance 53. In other words, as frame 14 tilts to the Trendelenburg position or reverse Trendelenburg position, rollers 55 move in the channels 36, 38 toward head end 54. As discussed above, the complementary open and closed profiles of channels 36, 38 facilitates movement of rollers 55. It is understood that rollers 55 can be provided with separate channels to accommodate tilting frame 14, or roller assembly 49 can be replaced by other suitable mechanisms such as a hinged linkage assembly.

Figure 2:
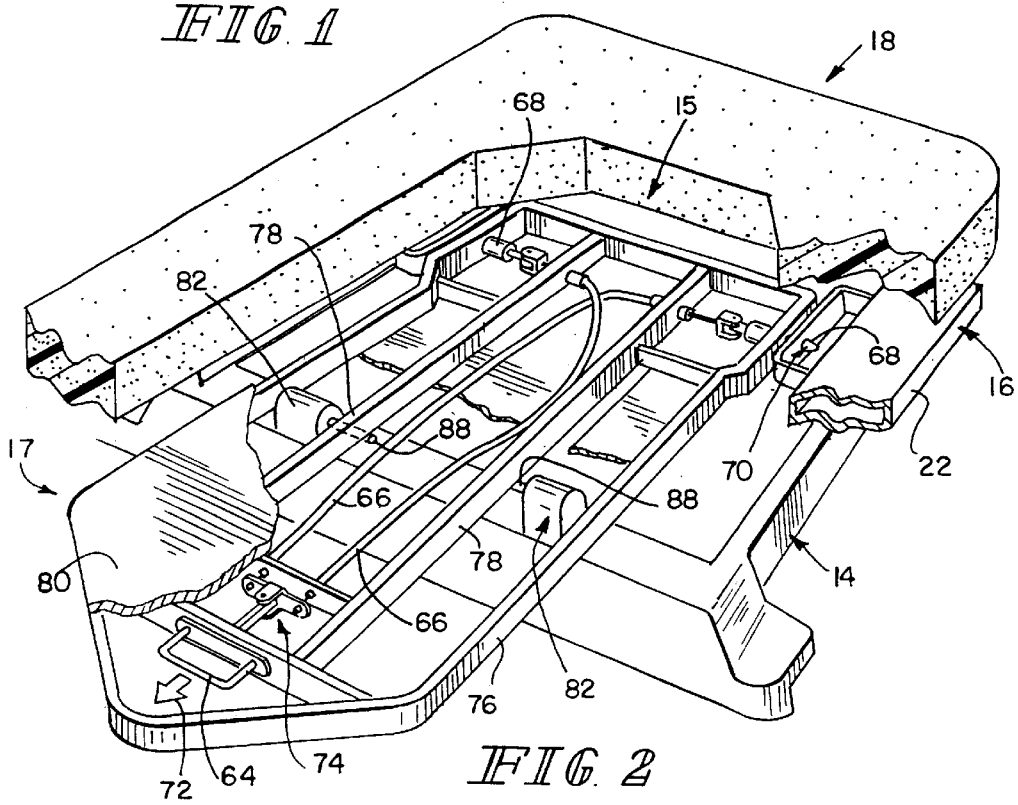
FIG. 2 is a perspective view of a portion of the stretcher of FIG. 1 showing a foot end section of the stretcher, with portions cut away to show a movable central leg section of the deck having a releasable latching mechanism to allow for movement of the movable section to a stowed position beneath a central portion of the deck.

Center leg support 17 is configured to be coupled to deck 16 within opening 15 to provide for a conventional stretcher configuration as shown in FIG. 2. Center leg support 17 illustratively includes a release handle 64 coupled to a pair of cable assemblies 66 that control a pair of latching pins 68. Pins 68 enter holes 70 in seat section 22 of deck 16 to latch support 17 to deck 16. When release handle 64 is moved toward the foot end of stretcher 10 as illustrated by arrow 72, a linkage 74 causes cables within cable assemblies 66 to retract latching pins 68 from holes 70. Center leg support 17 can then be moved to the stowed configuration as shown in FIGS. 3–4 to allow stretcher 10 to assume an Ob/Gyn configuration. It is understood that any suitable mechanism for latching center leg support 17 in a conventional support position can be used. Similarly, release handle 64 and the associated components for releasing center leg support 17 for movement to the stowed position can be replaced by other suitable mechanisms. Center leg support 17 is illustratively formed from relatively light weight metal components including a tubular perimeter frame 76, longitudinal center support beams 78, and a sheet metal top surface 80.

Figure 21:
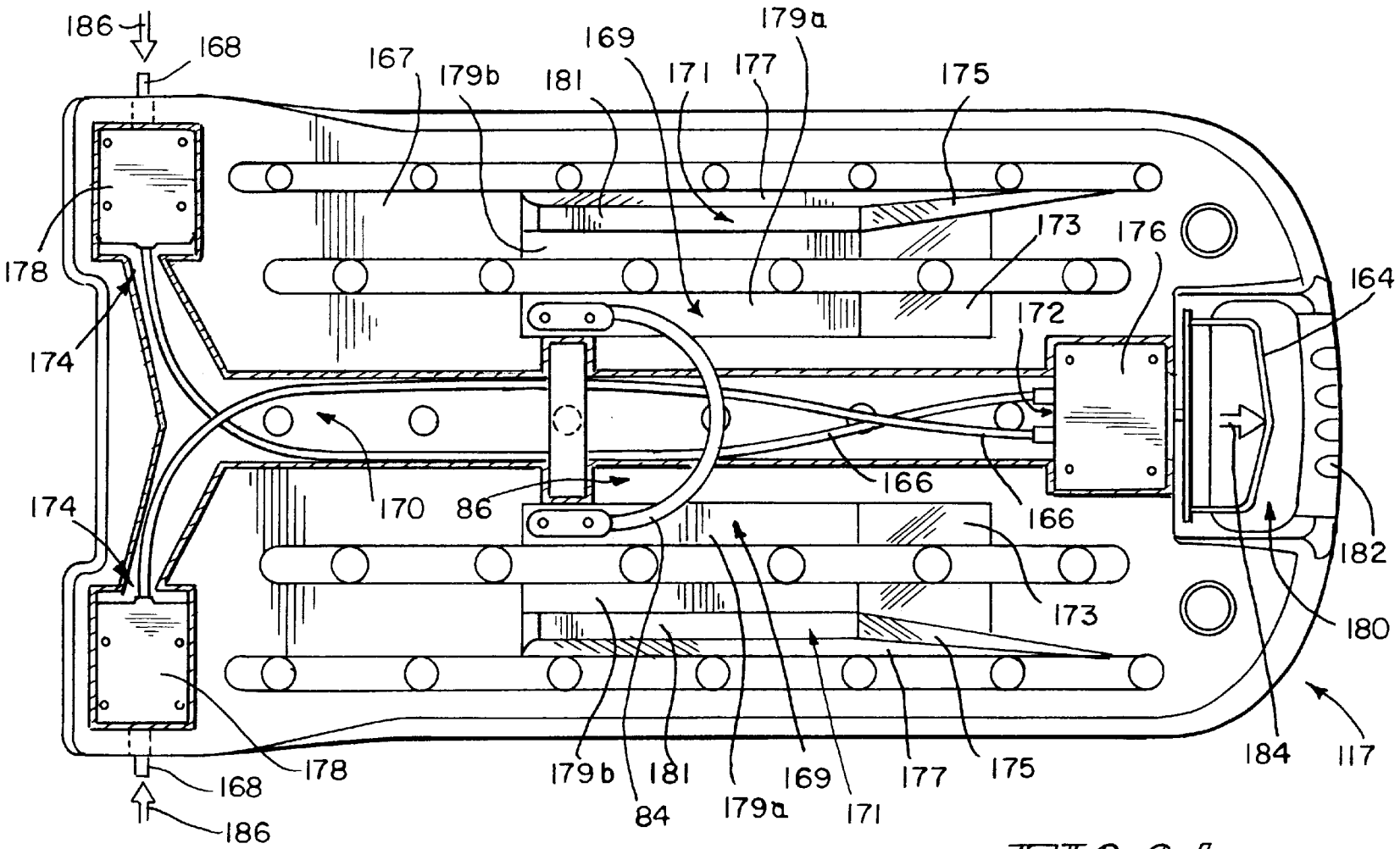
FIG. 21 is a bottom plan view of an alternative embodiment center leg support, showing latch control cable assemblies within a channel formed on the support bottom.

An alternative embodiment center leg support 117 is formed from molded plastic as shown in FIG. 21. Center leg support 117 includes a release handle 164, cable assemblies 166, and latching pins 168 that are similar to corresponding components of leg support 17. Center leg support 117 has a bottom surface 167 that includes a channel 170 extending longitudinally from release handle 164 and branching laterally towards latching pins 168 for receiving cable assemblies 166. Recesses 172, 174 and plates 176, 178 are provided to retain cable assembly 166 hardware from extending below the bottom surface 167 of center leg support 117. An ergonomic hand opening 180 is provided including finger grips 182 to facilitate operation of handle 164. Similar in operation to center leg support 17, when handle 164 is moved in direction 184, latching pins 168 retract in direction 186 to release the center leg support 117 from the holes 70 formed in the deck.

Center leg support 117 further includes a pair of bottom supports 171 that extend downwardly from bottom surface 167 to provide support surfaces 179*a* and 179*b* that engage frame 14 when support 117 is in the conventional stretcher configuration. Support surfaces 179*a* and 179*b* extend below the bottom surface 167. A forward ramp surface 173 extends between bottom surface 167 and each support surface 179*a* and 179*b*. Guide surfaces 181 are located below bottom surface 167 and below support surfaces 179*a* and 179*b*. A forward ramp surface 175 and lateral ramp surface 177 extend between the bottom surface 167 and each guide surface 181. Ramp surfaces 173, 175, 177 facilitate movement and alignment of support 117 when being moved from between the stowed position to a conventional stretcher configuration. Center leg support 117 is illustratively formed in a rotational plastic mold and is foam filled to produce a lightweight component with suitable rigidity, although it is understood that any conventional manufacturing or forming technique can be used.

When center leg supports 17, 117 are positioned to provide a conventional stretcher configuration, latching pins 68, 168 extend into holes 70 and a top surface of center leg supports 17, 117 is generally flush with the top surfaces of seat and outer leg deck sections 22, 24, 26. A center leg support mattress 19 is configured to lie atop center leg supports 17, 117 with a top surface of mattress 19 generally flush with a top surface of mattress 18. Frame 14 further includes a pair of center leg support pivot blocks 82 positioned above foot end hydraulic support 50 as shown in FIG. 2. Pivot blocks 82 support the bottom of center leg supports 17, 117 when in the conventional stretcher configuration and, as discussed below, facilitate moving center leg supports 17, 117 between the conventional stretcher configuration and the stowed configuration.

Figure 5:
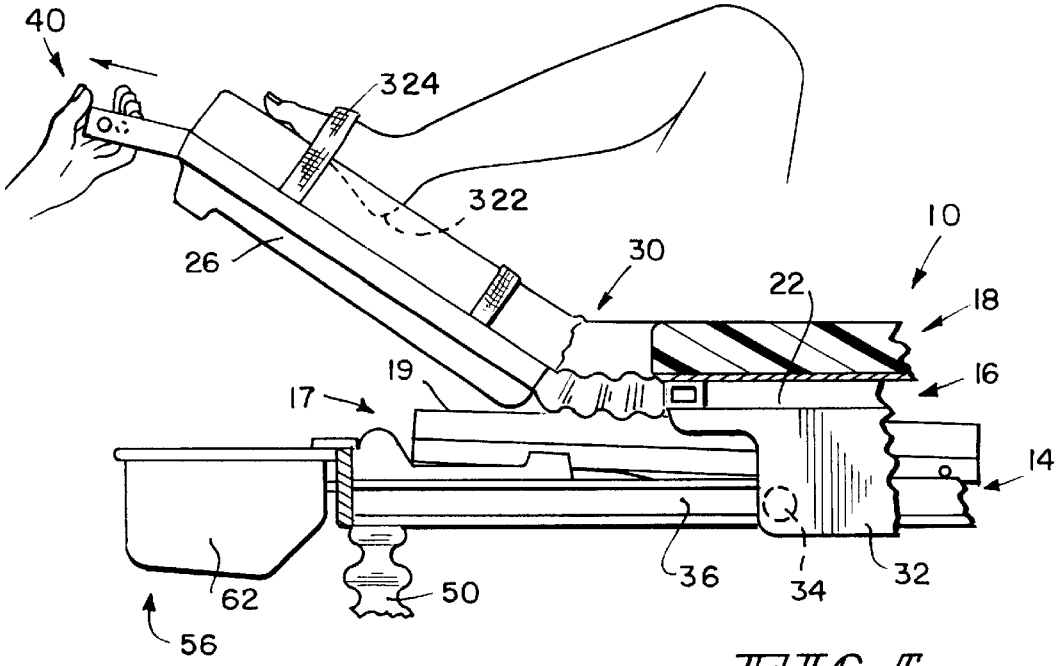
FIG. 5 is a side elevation view of the foot end portion of the stretcher of FIG. 1, with a portion broken away to show the movable central leg section in the stowed position and an adjustable outer leg section raised to support a patient in a lithotomy or parturition position.

Center leg supports 17, 117 illustratively include a bottom U-shaped rod 84 configured to define a rod pocket 86 between rod 84 and the bottom of center leg support 17, 117. Pivot blocks 82 each include an inwardly extending stop pin 88 that is retained within rod pocket 86 when center leg support 17, 117 is in the conventional stretcher configuration as shown in FIG. 3. As shown in FIG. 21, support surfaces 179*a* and 179*b* slide over pivot blocks 82 when center leg support 17 is moved from a stowed position to a conventional stretcher position. Outer guides 171 engage outer portions of the pivot blocks 82 to align the center leg support 117 relative to the frame 14. Rod 84 engages stops 88 when the 117 leg support is moved fully toward the foot end of frame 14. Center leg support 117 is then pivoted around pivot blocks 82 until latch pins 168 engage apertures 70 of frame 14. Center leg support 17 includes similar support surfaces 79 and ramp surfaces 73 for engaging pivot blocks 82 as shown in FIGS. 3–5.

Referring now to FIG. 3, when center leg support 17 is unlatched from deck 14 by pulling handle 64 in direction 72 to retract pins 68, the foot end of center leg support 17 can be rotated upwardly in direction 90 so that the opposite end rotates downwardly in direction 92 as center leg support 17 rotates about pivot blocks 82. A storage cavity 94 configured to receive center leg support 17 is defined between deck 16 and frame 14. After rotating center leg support 17 about pins 88, center leg support 17 can be moved as shown by arrows 96, 98 in FIG. 3 to its stowed position within cavity 94 as shown in FIG. 4. Although the illustrated embodiments employ pivot blocks 82 and rod 84, it is understood that other suitable mechanisms can be used to facilitate moving center leg support 17 between the conventional stretcher and stowed configurations.

Center leg support 17, 117 is moved from the stowed configuration to the conventional stretcher configuration by reversing the above-described steps. In this sequence, pivot blocks 82 guide movement of center leg support 17, 117 and also provide a stop to prevent center leg support 17 from being pulled out past the point where it is rotated into the conventional stretcher configuration. This stop function is accomplished when pins 88 engage rod 84 to stop center leg support 17 from extending past the point at which it is rotated back up to couple to deck 16 in the conventional stretcher configuration.

Figure 6:
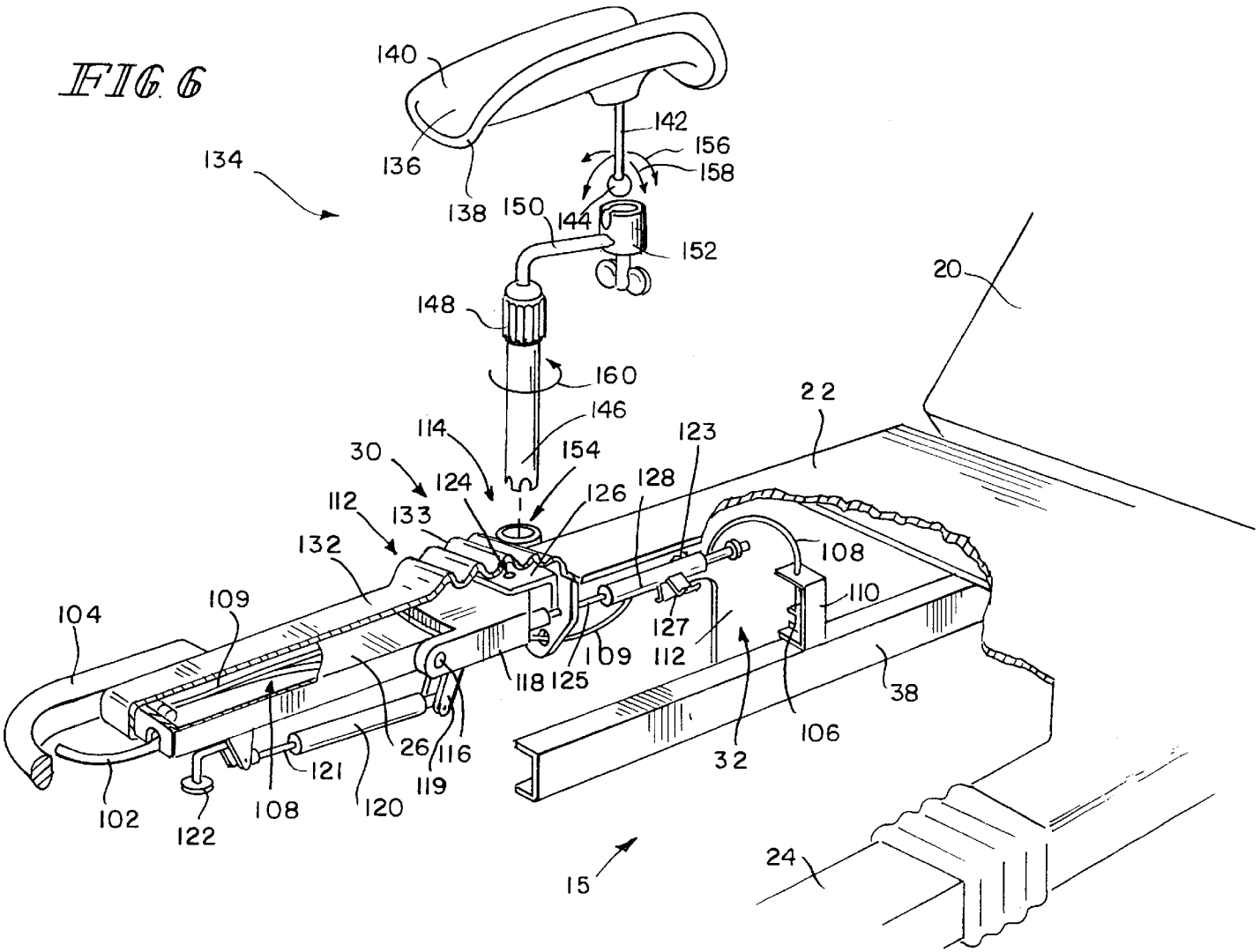
FIG. 6 is a perspective view of the foot end portion of the stretcher of FIG. 1, with a portion broken away to show an outer leg section adjustment mechanism and showing a removable, adjustable calf support assembly.

Deck release mechanism 40 illustratively is a cable-actuated mechanism and includes a lever 102 coupled to each of the deck outer leg sections 24, 26 as best shown in the view of right outer leg deck section 26 in FIG. 6. As discussed in more detail below, a second cable-actuated mechanism coupled to levers 102 also enables horizontal rotation in hinge assembly 30 of outer leg deck sections 24, 26.

Outer leg deck sections 24, 26 include gripping handles 104 that are coupled to deck sections 24, 26. Gripping handles 104 and levers 102 provide an ergonomic mechanism that allows an operator to actuate levers 102 while gripping handles 104. Pulling each lever 102 enables horizontal rotation of a respective one of outer leg deck sections 24, 26 about pivot connection 124 by releasing a mechanical lock 128 and also retracts a frame latching pin 106. When both levers 102 are pulled simultaneously, both frame latching pins 106 are retracted from apertures in the frame 14, and deck 16 can be moved longitudinally relative to frame 14 in the direction of arrow 103 as shown for example in FIG. 7. As discussed above, rollers 34 roll in channels 36, 38 as the deck 16 moves relative to the frame 14. Since both levers 102 adjacent handles 104 of outer leg deck sections 24, 26 must be activated to release the deck 16, a caregiver must be positioned at a foot end 56 of stretcher 10 to release the deck 16. This positioning of the caregiver provides improved control for movement of the deck 16.

It is understood that levers 102 can be replaced by other suitable mechanisms, such as a single button or two buttons that perform the functions of enabling horizontal rotation of outer leg deck sections 24, 26 and horizontal movement of deck 16 relative to frame 14. Furthermore, although center leg support 17 in the illustrated embodiment prevents deck 16 from moving toward foot end 56 when stretcher 10 is in the conventional stretcher configuration, it is understood that alternative leg supports could be coupled to deck 16 to allow such movement.

Each lever 102 is coupled to a control cable 108 that is coupled to frame latching pin 106. Frame latching pins 106 are each mounted to a bracket 110 that is coupled to an inside wall 112 of deck carriage plate 32 so that latching pins 106 and brackets 110 move along with deck 16 relative to frame 14. Latching pins 106 are configured to enter holes (not shown) in channels 36, 38 to latch deck 16 in first and second predefined positions relative to frame 14. Pins 106 lock in a first pair of apertures in channels 36, 38 when the deck 16 is in a conventional stretcher position of FIG. 1. Pins 106 lock in a second pair of apertures formed in channels 36, 38 when the deck 16 is rolled to its examination position shown in FIG. 7. When lever 102 is pulled, cable 108 releases the pin 106 from the channel 36 or 38 allowing the deck 16 to move relative to the frame 14. It is understood that other suitable mechanisms can be provided, such as a latching mechanism that provides for infinite longitudinal adjustment instead of predefined positions defined by holes in channels 36, 38.

Figure 12:
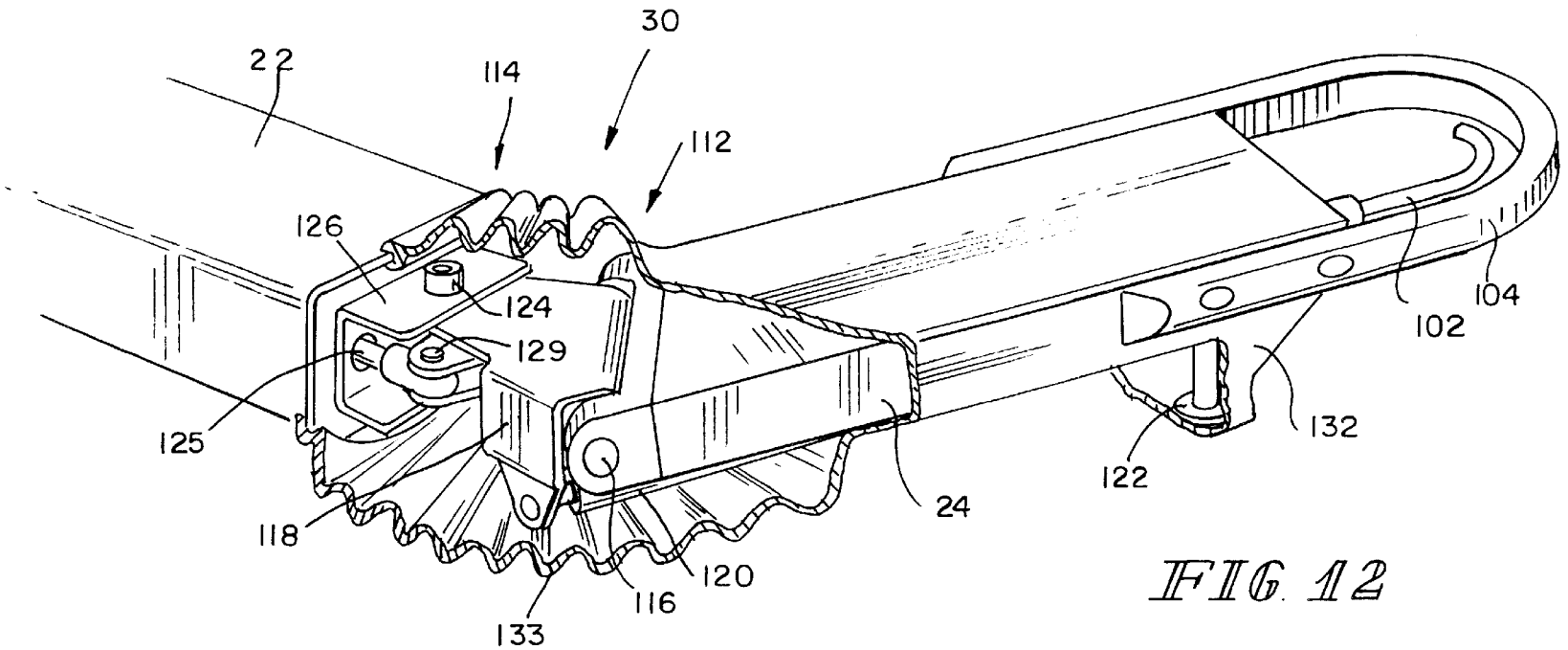
FIG. 12 is a detail perspective view of the left outer leg deck section of FIG. 1, with a portion of a flexible cover broken away to show vertical and horizontal hinge assemblies.
Figure 13:
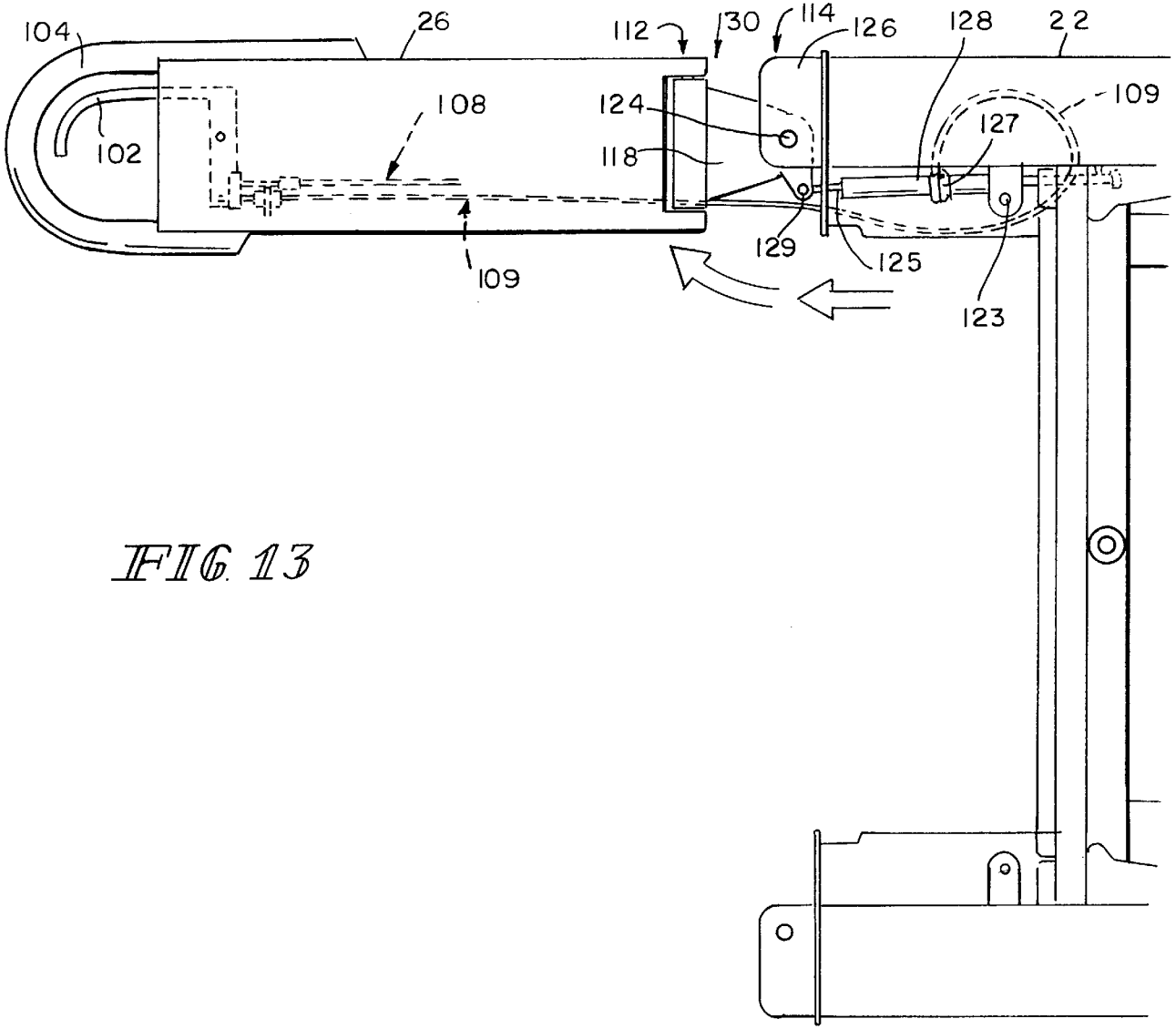
FIG. 13 is a plan view showing a control mechanism for vertical and horizontal hinge assemblies for the right outer leg deck section of FIG. 1.

As mentioned above, hinge assembly 30 of outer leg deck sections 24, 26 provides for both horizontal and vertical rotation. Each hinge assembly 30 includes a vertical pivot 112 and a horizontal pivot 114 as best shown in FIGS. 6 and 12–13. Vertical pivot 112 is formed by a horizontal pin 116 coupled between an end of deck outer leg sections 24, 26 and hinge assembly bracket 118. A vertical adjustment cylinder 120 is pivotably coupled at one end to bracket 118 by connection 119. A piston 121 extends from each cylinder 120. A piston 121 is coupled to each outer leg section 24, 26. An actuation button 122 underneath outer leg sections 24, 26 is pressed to release piston 121 to move within cylinder 120. Each outer leg section 24, 26 can be rotated vertically upon actuation of button 122 and is infinitely adjustable within its range of vertical rotation by releasing button 122 to lock the piston 121 and hold the leg section 24, 26 at a desired orientation.

Horizontal pivot 114 is formed by a vertical pin 124 coupled between hinge assembly bracket 118 and a bracket 126 mounted to deck seat section 22. A horizontal adjustment mechanical lock includes an outer cylinder 128 pivotably coupled to seat section 22 by pivot pin 123 as shown in FIGS. 6 and 13. A rod 125 moves back and forth within the cylinder 128 of the mechanical lock when an actuator 127 is released by control wire 109 when lever 102 is pulled. When lever 102 is released, the actuator holds the rod 125 in a locked position relative to cylinder 128. An end of rod 125 is pivotably coupled to a flange of bracket 118 by pivot pin 129 as best shown in FIGS. 12 and 13. It is understood that other mechanisms for hinge assembly 30 can be provided, such as a single universal joint with a single actuation and latching mechanism for enabling rotation about two or more axes.

Outer leg sections 24, 26 are surrounded by a flexible covering 132 that includes a generally bellows-shaped section 133 located over hinge assembly 30. Bellows 133 therefore permits pivotable movement of the leg sections 24, 26. Covering 132 also surrounds actuator 122 as best shown in FIG. 12. Covering 132 is illustratively formed from a rubber material, although it is understood that any suitable covering may be used. Covering 132 facilitates cleaning of the outer leg sections 24, 26.

Stretcher 10 includes removable calf supports 134 as best shown in FIG. 6. Support 134 includes a calf support tray 136 configured with a rounded perimeter 138, a concave calf support surface 140. A mounting rod 142 is coupled at one end to support tray 136 and has a generally spherical joint ball 144 at another end. Support 134 further includes a mounting shaft 146, a raised gripping surface 148, an offset arm 150, and a joint socket 152. Mounting shaft 146 is configured to be removably retained within a calf support socket 154 coupled to an outside surface of deck seat section 22. Ball 144 and socket 152 provide for dual axis rotational adjustment of support tray 136 in directions 156, 158. Furthermore, rotation of mounting shaft 146 in direction 160 combined with offset arm 150 provides for a wide range of horizontal adjustment of calf support 134. When not in use, calf supports 134 are stored in a pair of storage receptacles 135 in frame 14 as shown in FIG. 14. Receptacles 135 are formed from openings 137 in frame 14 that are spaced laterally inward from channels 36, 38. Mounting shafts 146 are inserted into openings 137, and L-shaped members 139 that extend longitudinally from atop openings 137 engage shafts 146 to retain calf supports 134 within frame 14.

Figure 9:
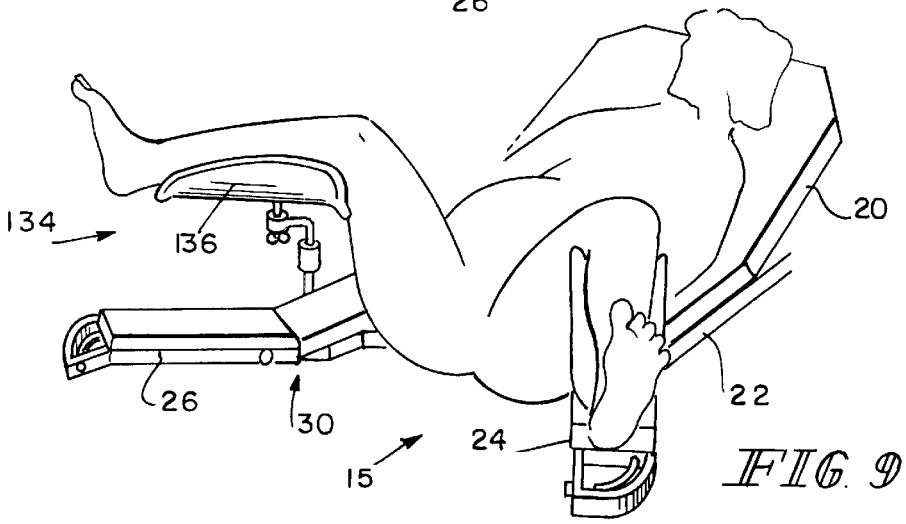
FIG. 9 is a perspective view of the stretcher of FIG. 1, showing the deck, mattress, and calf supports configured for a patient in a birthing position or for an Ob/Gyn examination.
Figure 10:
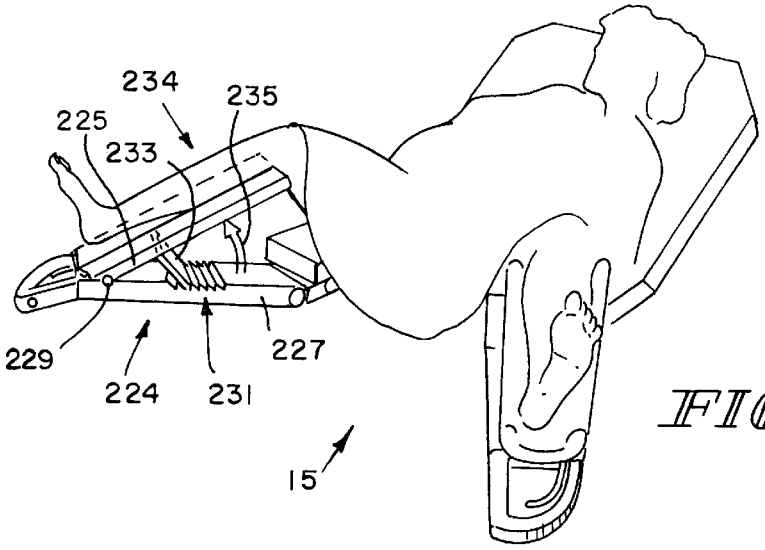
FIG. 10 is a perspective view showing an alternative leg support embodiment, with the outer leg sections adjusted to a calf support configuration to support a patient in a birthing position or for an Ob/Gyn examination.
Figure 11:
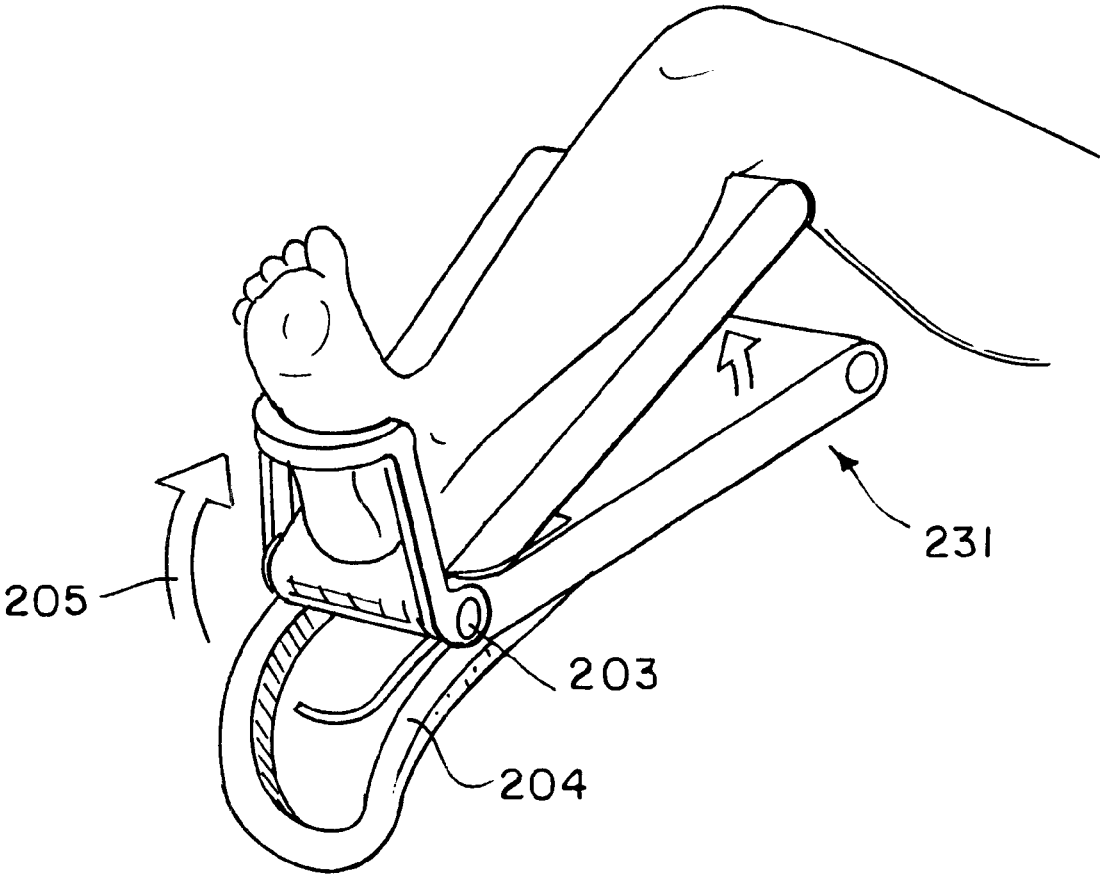
FIG. 11 is a detail perspective view of another alternative leg support embodiment similar to FIG. 10, showing a hinged calf support section and a hinged outer leg section handle configured as a foot support.

Stretcher 10 can thus be configured to provide improved access to a patient's pelvic region while supporting the patient in a lithotomy or parturition position as shown FIG. 9. An alternative embodiment calf support 234 is shown in FIG. 10. An outer leg deck section 224 includes top and bottom sections 225, 227 coupled by a pivot 229. Bottom section 227 includes a plurality of notches 231 and top section 225 includes a hinged plate 233 so that when top section 225 is rotated upwardly in direction 235, plate 233 is rotated down to enter one of notches 231 to retain top section 225 at a desired angle with respect to bottom section 227. An alternative handle 204 is configured to provide a foot support as shown in FIG. 11. A hinge 203 allows for rotating handle 204 upwardly in direction 205 to provide a support for a patient's foot. It is understood that other mechanisms can be provided to include a calf support within outer leg sections 24, 26, such as various linkage assemblies to adjust all or part of the deck section as required to conform to a desired orientation for calf support.

Figure 15:
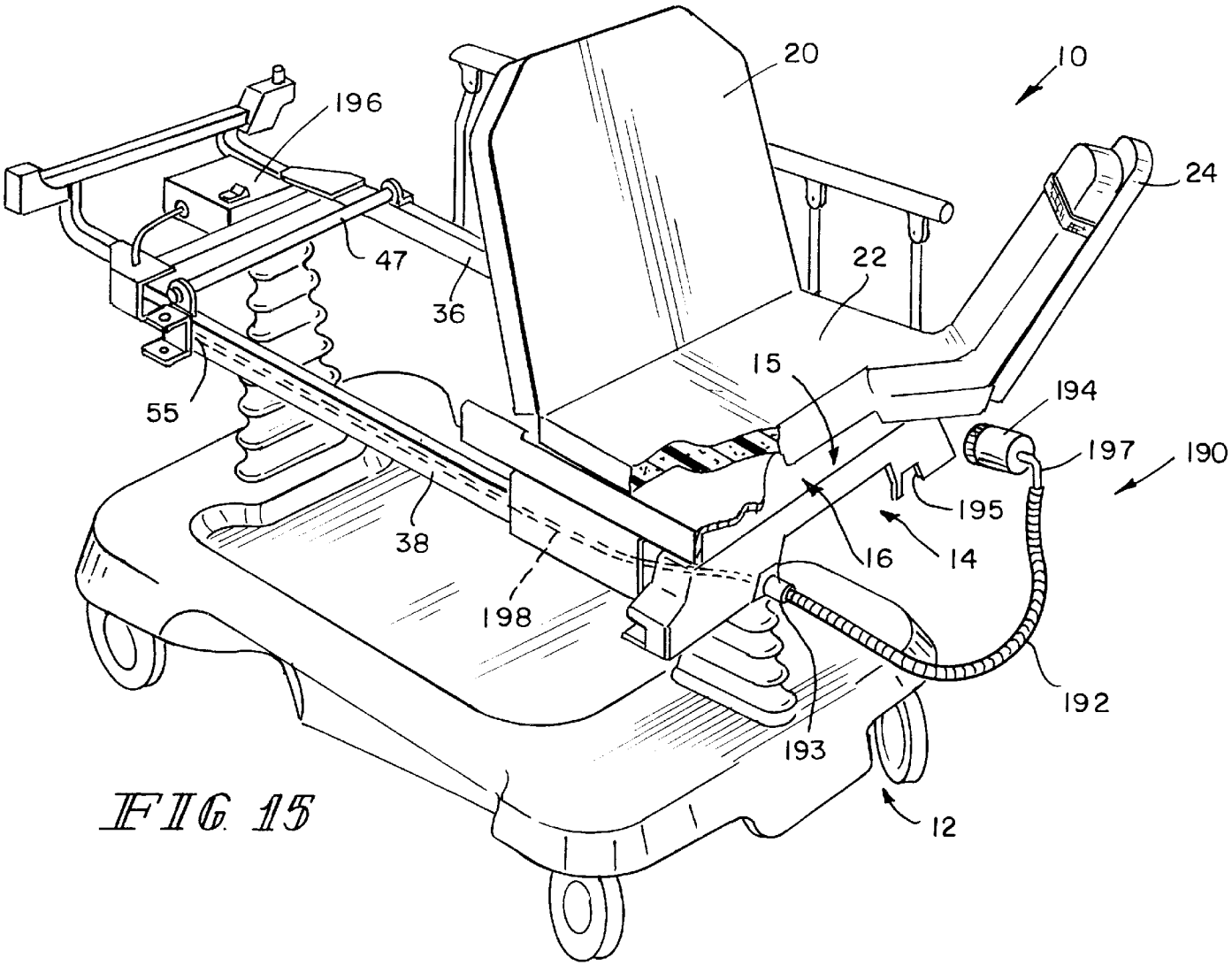
FIG. 15 is a perspective view of a stretcher according to the present invention with a deck and mattress moved forward on a frame to provide access to an Ob/Gyn patient and with portions broken away to show a lighting system.

Stretcher 10 can further be configured with an examination light system 190 as shown in FIG. 15. Light system 190 illustratively includes a flexible connector 192 coupled to a light head 194. Once positioned, the flexible connector 192 holds the light head 194 at the foot end 56 of stretcher 10 to allow for directing light in a convenient manner. Light system 190 further illustratively includes a light source 196 coupled to frame 14 adjacent head end 54 and a fiber-optic supply link coupled between cable 192 and source 196. The light source 196 may also be coupled to the deck 16 or base 12. It is understood that other suitable light systems can be used for light system 190, and that it can be attached or incorporated into frame 14 as desired. Stretcher 10 can be wheeled from place to place within a hospital or other facility. A particular room may not have adequate lighting for the stretcher 10. Since the light system 190 is incorporated into the frame of the stretcher 10, a suitable light source for examination is always available regardless of the location of the stretcher 10.

The light source 196 includes a power cord (not shown) configured to be coupled to a power outlet of a wall. The light source 196 is coupled to the base 12, frame 14, or deck 16 at a location spaced apart from the central opening 15 formed in the deck 16. Therefore, the light source 196 is located at a remote location from the area that is likely to be exposed to fluids during an examination or medical procedure. The light head 194 is located adjacent the central opening 15 to provide light for the examination. The flexible connector 192 is configured to be received within a first receptacle 193 formed in the frame 14 to position the flexible connector adjacent the foot end of the frame 14. A retaining clip 195 is configured to engage neck portion 197 of connector 192 to hold the light head 194 in a storage position when not in use.

Mattress 18 as shown in FIGS. 17–20 is configured to be coupled atop deck 16. Mattress 18 includes a head section 310, a seat section 312, and left and right outer leg sections 314, 316 that are sized to cover respective deck head, seat, and outer leg sections 20, 22, 24, 26. Head and seat sections 310, 312 are coupled by a V-shaped hinge 311 to facilitate rotation between them. Seat and outer leg sections 312, 314, 316 are coupled by soft foam portions 315 illustrated in FIGS. 18 and 19 that allow for both horizontal and vertical rotation over hinge assemblies 30.

Figure 17:
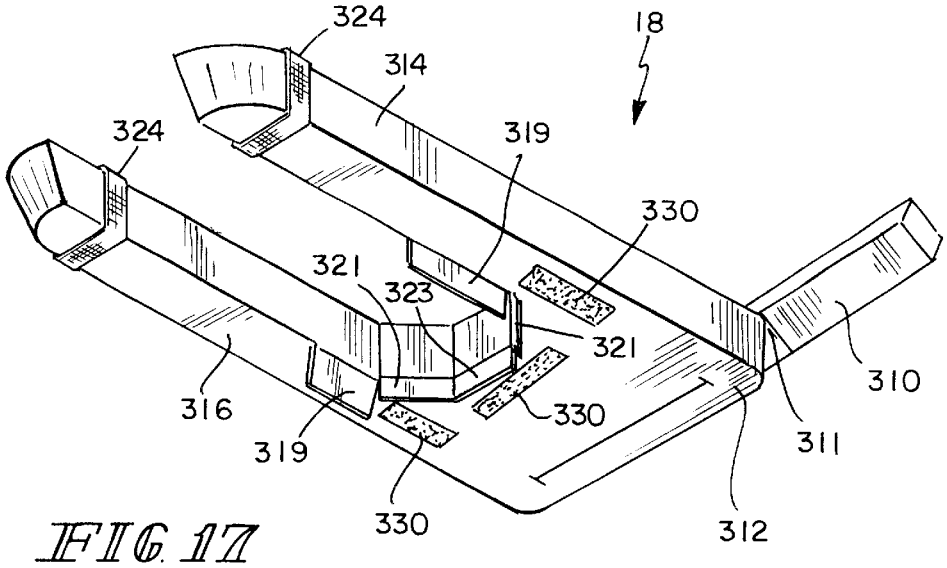
FIG. 17 is a perspective view looking up towards the bottom of the mattress assembly of FIG. 16, showing the foot straps, drip flap, and Velcro strips for coupling the mattress to a deck.
Figure 16:
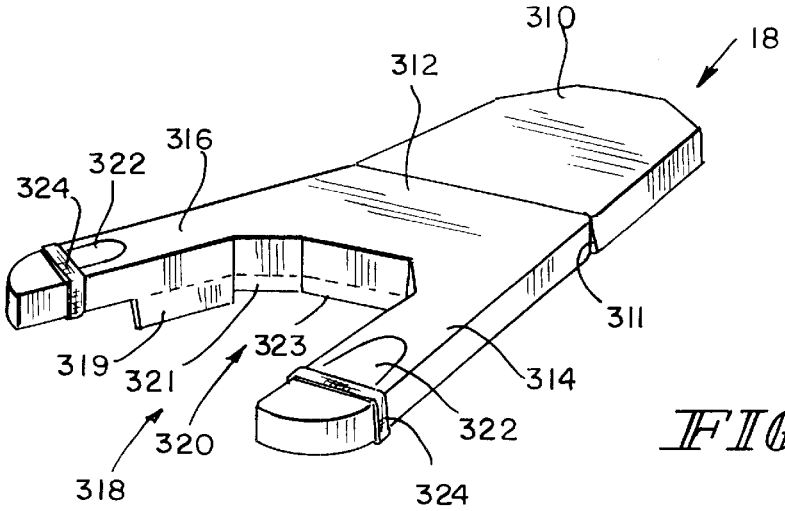
FIG. 16 is perspective view looking down towards the top of a mattress assembly according to the present invention, showing foot straps and heel cut-outs in two outer leg mattress sections, a drip flap extending around an opening between the outer leg mattress sections and a central mattress section, and a head mattress section coupled to the central mattress section for articulated movement.

Seat and outer leg sections 312, 314, 316 define between them a center leg opening 318. Mattress 18 includes a drip flap 320 that extends downwardly around a portion of opening 318. Drip flap 320 reduces exposure of deck 16 and frame 14 adjacent opening 318 to moisture when center leg support 17 is in the stowed configuration. Drip flap 320 illustratively includes two outer segments 319, two bevel segments 321, and an inner segment 323 as best shown in FIGS. 16–17. Outer segments 319 illustratively extend downwardly farther than bevel and inner segments 321, 323. Drip flap 320 in conjunction with catch basin 62 facilitates containment of fluids often encountered during procedures such as childbirth.

Figure 18:
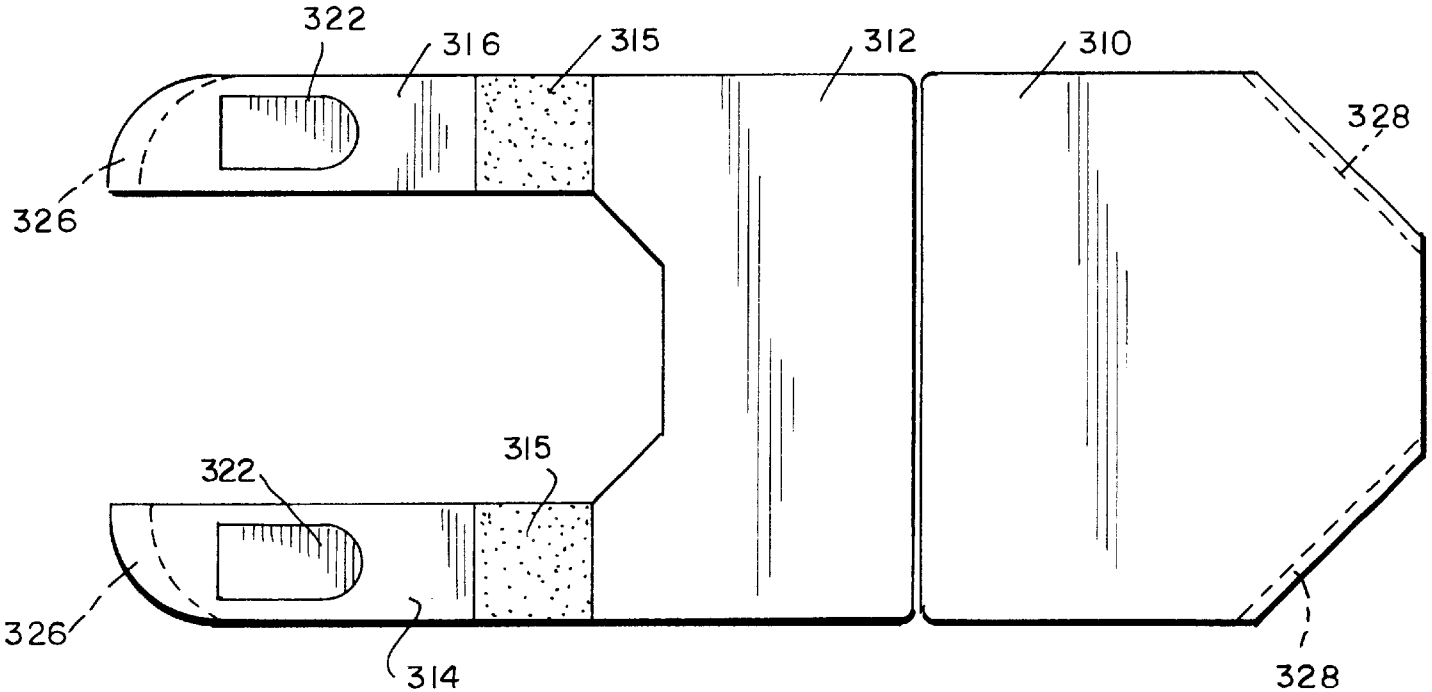
FIG. 18 is a top plan view of the mattress assembly of FIG. 16, showing the heel cut-outs and a pair of soft foam mattress portions coupled between outer leg mattress sections and the central mattress section.
Figure 19:
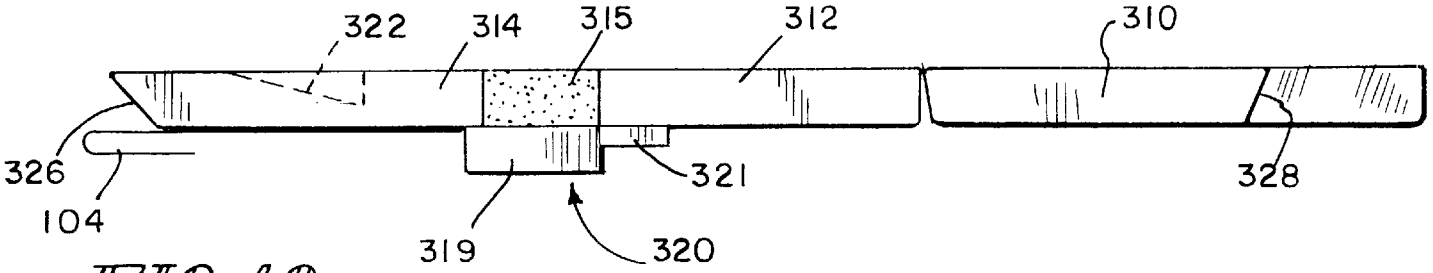
FIG. 19 is a side profile view of the mattress assembly of FIG. 16, showing the drip flaps extending below the mattress bottom and bevels on the outer leg and head mattress sections.
Figure 20:
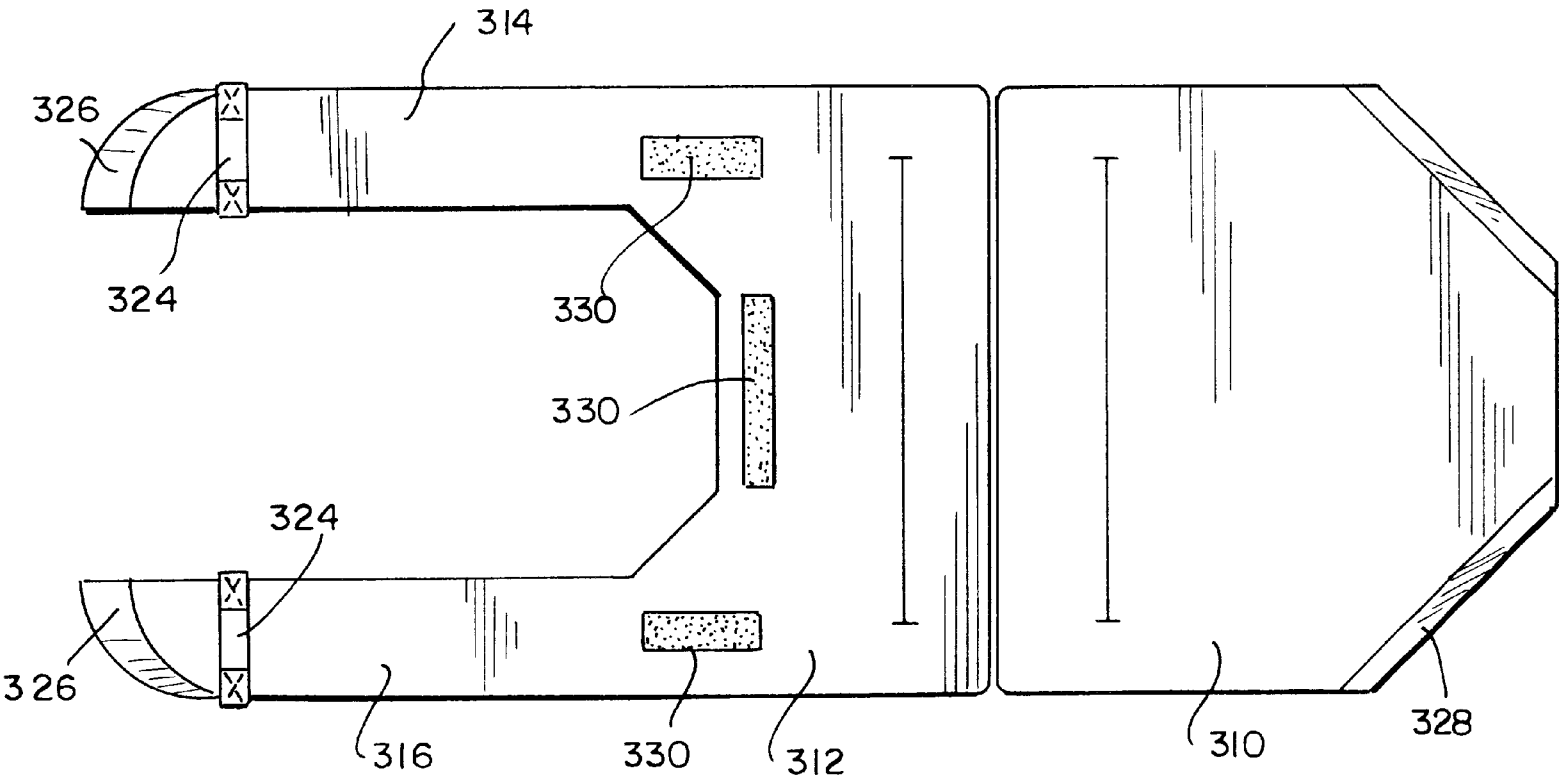
FIG. 20 is a bottom plan view of the mattress assembly of FIG. 16, showing foot straps, velcro strips, and flaps for installing foam into mattress covers for the central and head mattress sections.

Mattress 18 further includes heel cut-outs 322 and foot straps 324 in outer leg sections 314, 316. Cut-outs 322 provide a support surface for a patient's foot when outer leg sections 314, 316 are in a raised position, as shown for example in FIGS. 5 and 7. Mattress 18 illustratively includes foot end bevels 326 and head end bevels 328 as best shown in FIGS. 18-20 and is formed with a foam core and a washable outer cover, although any suitable materials can be used. Foot end bevels 326 facilitate access to handles 104 as shown in FIG. 19. Mattress 18 further illustratively includes Velcro strips 330 on its bottom surface that couple to matching strips (not shown) on deck seat portion 22 to provide for removably coupling mattress 18 to deck 16.

Figure 1:
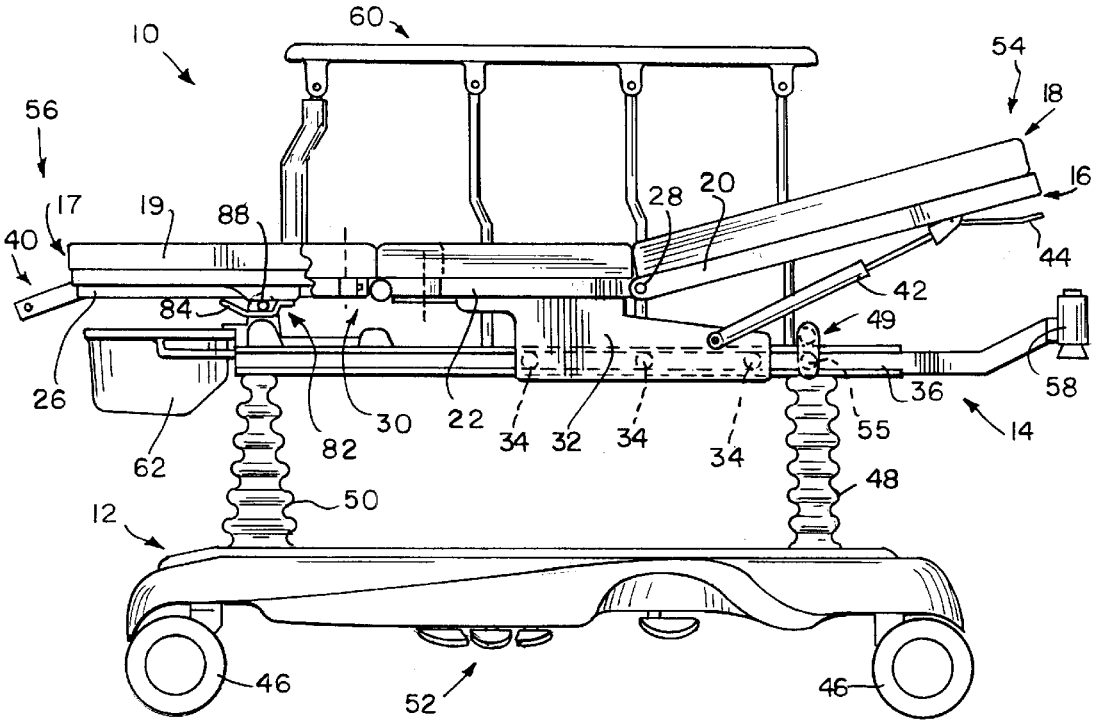
FIG. 1 is a side elevation view of an Ob/Gyn stretcher according to the present invention showing a base, a frame coupled to the base, a deck coupled to the frame, a mattress located on the deck, a siderail and a catch basin coupled to the frame, and an articulating head section of the deck in a raised position.
Figure 7:
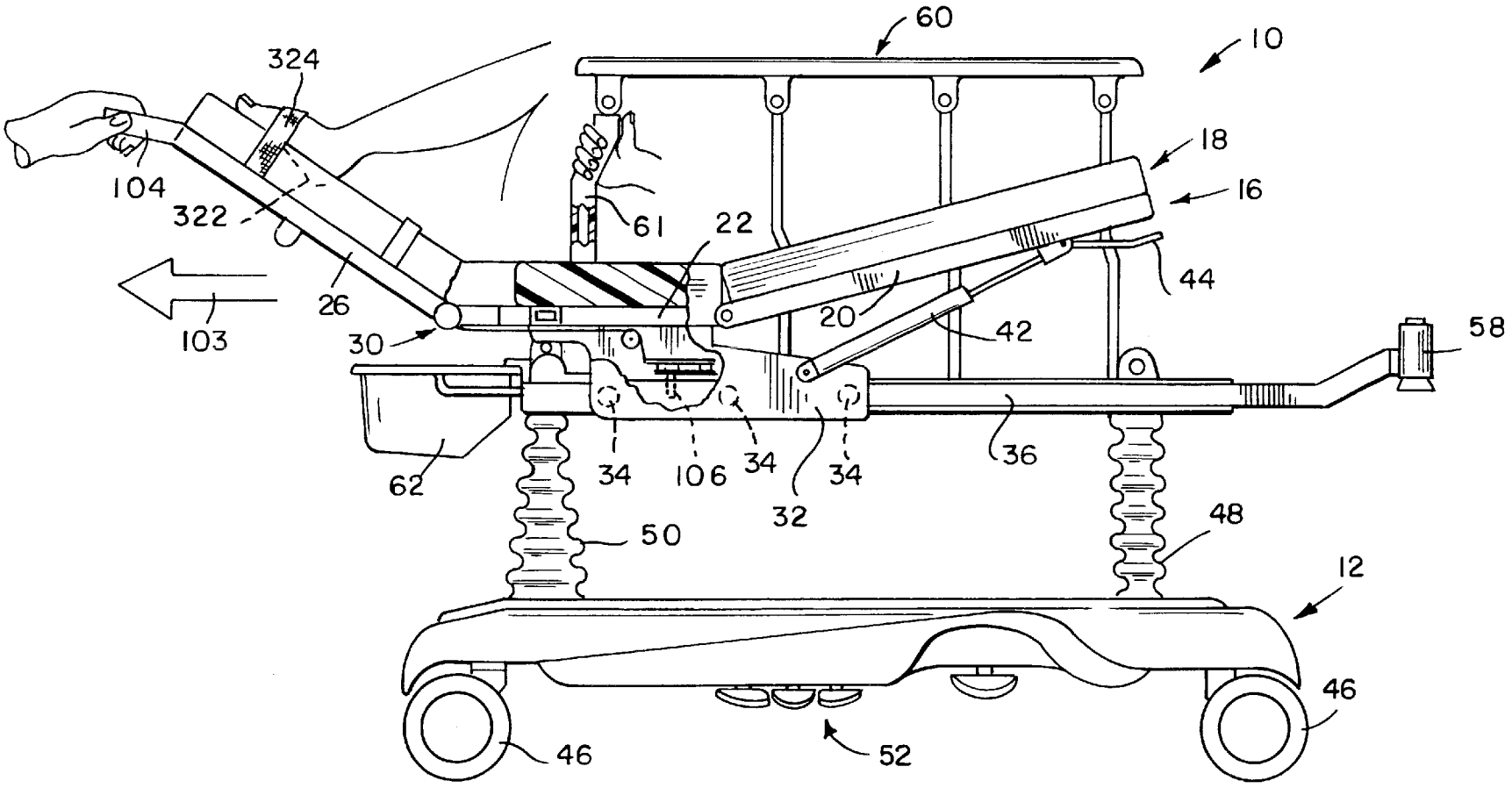
FIG. 7 is side elevation view of the stretcher of FIG. 1, with a portion broken away to illustrate the deck moved toward the foot end portion of the frame and an outer leg section in a raised position to support a patient in a birthing position or for an Ob/Gyn examination.

In operation, when a patient is first placed on stretcher 10, the stretcher 10 is located in the conventional stretcher configuration illustrated in FIG. 1. The deck 16 can be articulated to adjust the position of the patient on the stretcher 10. When it is desired to move the stretcher to the OB/GYN configuration, a caregiver will typically first move the outer leg sections 24 and 26 upwardly relative to the seat section 22 by depressing buttons 122 beneath the outer leg sections 24, 26. This releases pistons 121 and permits the outer leg sections to be pivoted upwardly as shown in FIGS. 7–8.

Next, the center leg support 17, 117 is stowed. To stow the center leg support 17, 117, a caregiver pulls the release handles 64, 164, respectively, toward the foot end 56 of stretcher 10. This releases pins 68, 168 from apertures 70 formed in deck 16. Therefore, the center leg support 17, 117 can be pivoted downwardly about pivot blocks 82 as shown in FIG. 3. Center leg support 117 is then pushed toward the head end 54 of stretcher 10 in the direction of arrow 96 and arrow 98 of FIG. 3 to a storage position as shown in FIGS. 4 and 5.

Figure 8:
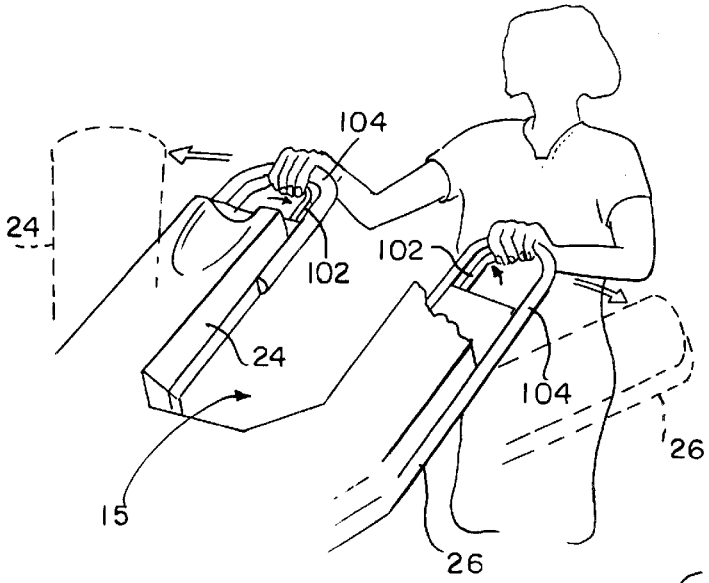
FIG. 8 is a perspective view of the foot end portion of the deck and mattress of FIG. 1, showing operator adjustment of the outer leg sections.

Next, the caregiver located at foot end 56 of stretcher 10 grips both handles 104 as shown in FIG. 8. Caregiver then actuates levers 102 by moving the levers 102 toward the foot end 56 of stretcher 10. Actuation of levers 102 simultaneously releases the latches 106 and mechanical locks 128 coupled to control wires 108 and 109, respectively. When pins 106 are released from both sides of the deck 16, rollers 34 can roll in channels 36, 38 toward the foot end 56 of the stretcher 10 to an examination position shown in FIG. 7. Pins 106 will latch into apertures in channels 36, 38 to maintain the deck in the examination position shown in FIG. 7. Siderail 60 includes a padded bar 61 which is configured to provide a grip handle for the patient as best shown in FIG. 7. Illustratively, the grip handle is formed by a generally S-shaped section formed in the bar 61. However, the padded grip handle may be formed on a straight tube or bar of the siderail.

The caregiver can then adjust the leg sections 26 outwardly about pivot 24 while levers 102 are actuated. In other words, the caregiver can move the leg sections 24, 26 to the dotted position shown in FIG. 8 to improve access to a pelvic region of the patient. Next, patient's legs can be adjusted using one of the various illustrated calf supports. The leg sections 24 and 26 and calf supports can be adjusted to a desired location throughout the examination.

Once the procedure is over, the stretcher 10 can be converted back to a conventional stretcher configuration by the caregiver by gripping both handles 104 on outer leg sections 24, 26 and actuating levers 102. The outer leg sections 24, 26 are first adjusted to be parallel with the remainder of the deck 16 using levers 102 and actuator 122. Actuating levers 102 also release pins 106 from the first set of apertures formed in channels 36, 38 to permit the rollers 34 on deck 16 to roll in channels 36, 38 back to the conventional stretcher position shown in FIG. 1. Pins 106 then latch in the second set of apertures formed in channels 36, 38 to hold the deck 16 in the conventional stretcher configuration. Center leg support 17, 117 is then retrieved from the storage position as shown in FIG. 4. The caregiver pulls the center leg support 17, 117 outwardly in the direction of arrow 72 of FIG. 3 until the bar 84 latches over locking pins 88 of pivot blocks 82. The center leg support 17, 117 is then pivoted upwardly about pivot blocks 82 until pins 68, 168 engage apertures 70 formed in deck 16 to lock the center leg support 17, 117, in position.

It is understood that the locations of pins 68 and holes 70 could be reversed. In addition, latch pins 106 could be formed on the frame and configured to enter apertures formed in the deck. Other types of latches may also be used, if desired.

Figure 23:
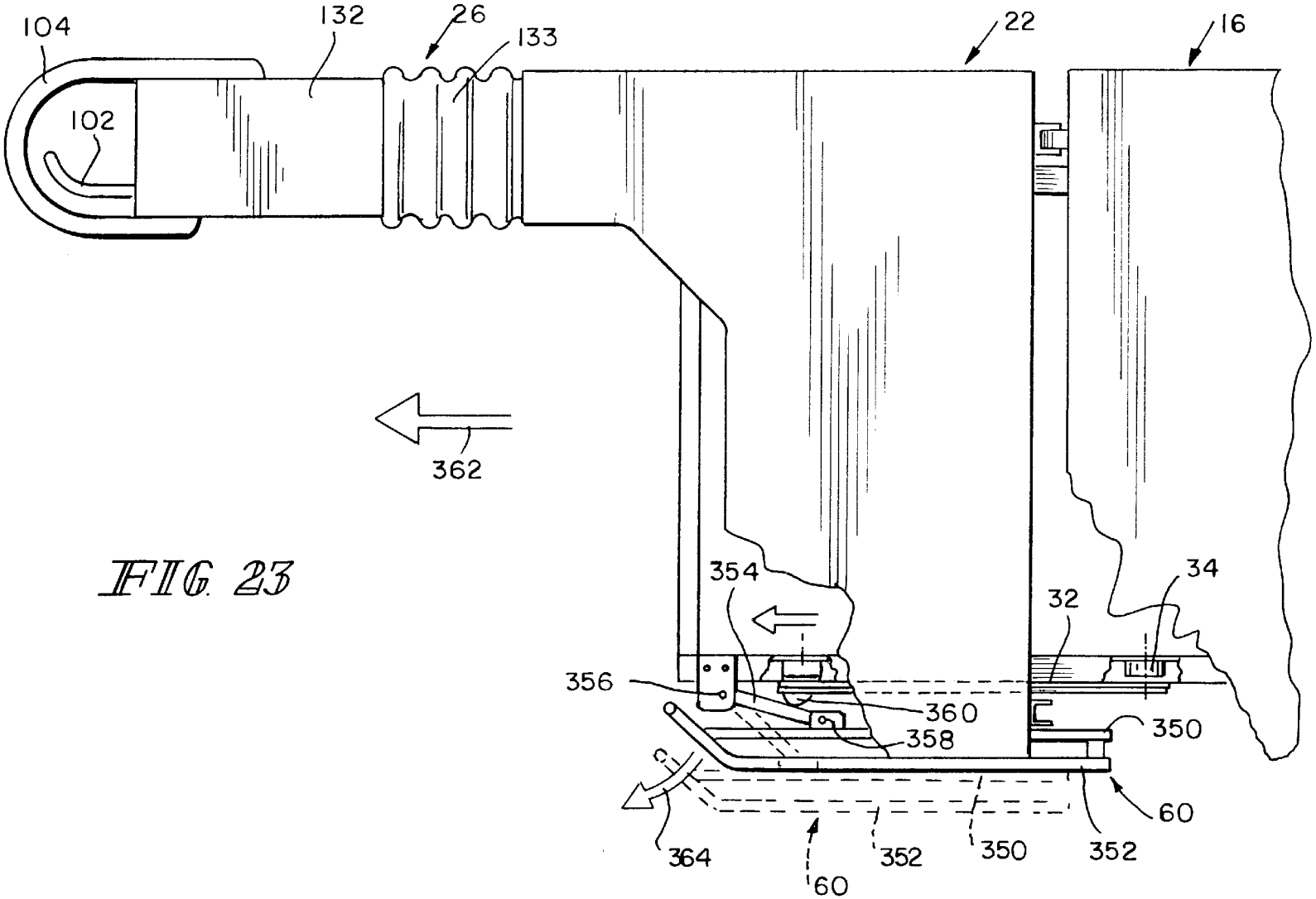
FIG. 23 is a top plan view, with portions broken away, illustrating a cam formed on the deck for moving a siderail outwardly relative to the frame.

Another aspect of the present invention is illustrated in FIG. 23. The siderail 60 includes a mounting rail 350 and an outer rail 352. The tubes or bars 61 of the siderail are pivotably coupled between the mounting rail 350 and the outer rail 352. Swing arms 354 are mounted on each end of the siderails 60. Each swing arm 354 includes a first end pivotably coupled to the frame 14 at location 356 and a second end pivotably coupled to the mounting rail 350 at location 358. A separate siderail 60 is mounted on both sides of the frame 14 in a conventional manner.

FIG. 23 also illustrates a cam 360 coupled to the carriage plate 32 of the deck 16. A cam 360 is coupled to carriage plates 32 on both sides of the deck 16. When the deck 16 slides toward the foot end of the frame 14 in the direction of arrow 362 as discussed above, the carriage 32 and the cams 360 also move in the direction of arrow 362. When the carriage 32 and cams 360 approach a foot end of the frame 14, the cams 360 engage the swing arms 354 of the siderail 60 to pivot the siderails 60 outwardly relative to the frame 14 in the direction of arrow 364 to the dotted location illustrated in FIG. 23. This movement of the siderails 60 provides clearance to permit the deck 16 to continue to move toward the foot end of the stretcher 10.

Although the invention has been described in detail with reference to certain illustrated embodiments, variations and modifications exist within the scope and spirit of the present invention as described and defined in the following claims.

What is claimed is:

1. A patient support apparatus comprising:

a base, a frame coupled to the base, the frame including a storage portion, a deck coupled to the frame, the deck including a head section, a seat section and first and second laterally spaced apart outer leg support sections adjacent the seat section, the seat section and the first and second outer leg support sections being configured to define a central opening therebetween, a removable center leg support configured for movement between a first position located within the central opening and coupled to the deck to provide a portion of the deck and a second storage position detached from the deck and located in the storage portion of the frame and below the deck, and a latch coupled to the center leg support to secure the center leg support to the deck in the first position, wherein the center leg support includes an actuator coupled to the latch, the actuator being located at a foot end of the center leg support and configured to move the latch between a latched position to lock the center leg support in the first position and an unlatched position, wherein the actuator includes a cable assembly having a first end coupled to the latch and a second end coupled to a handle, and wherein the center leg support includes a bottom surface formed to include a recess configured to receive at least a portion of the cable assembly.

2. A patient support apparatus comprising:

a base, a frame coupled to the base, the frame including a storage portion, a deck coupled to the frame, the deck including a head section, a seat section and first and second laterally spaced apart outer leg support sections adjacent the seat section, the seat section and the first and second outer leg support sections being configured to define a central opening therebetween, a removable center leg support configured for movement between a first position located within the central opening and coupled to the deck and above the frame to provide a portion of the deck and a second storage position detached from the deck and located in the storage portion of the frame and below the deck, and at least one pivot block coupled to the frame, the pivot block being configured to support the center leg support in the first position, wherein the center leg support includes a bottom having a support surface and at least one guide surface cooperating with the at least one pivot block to align and hold the center leg support in the first position.

3. The apparatus of claim 2, further comprising at least one ramp surface located adjacent the support surface to facilitate movement of the center leg support onto the at least one pivot block.

4. A patient support apparatus comprising:

a base, a frame coupled to the base, the frame including a storage portion, a deck coupled to the frame, the deck including a head section, a seat section and first and second laterally spaced apart outer leg support sections adjacent the seat section, the seat section and the first and second outer leg support sections being configured to define a central opening therebetween, a removable center leg support configured for movement between a first position located within the central opening and coupled to the deck and above the frame to provide a portion of the deck and a second storage position detached from the deck and located in the storage portion of the frame and below the deck, and first and second pivot blocks coupled to the frame, the center leg support including a bottom support surface configured to engage the pivot blocks and hold the center leg support in the first position, the center leg support further including first and second spaced apart guides located adjacent the bottom support surface, the guides being configured to position the center leg support relative to the first and second pivot blocks.

5. A patient support apparatus comprising:

a base, a frame coupled to the base, the frame including a storage portion, a deck coupled to the frame, the deck including a head section, a seat section and first and second laterally spaced apart outer leg support sections adjacent the seat section, the seat section and the first and second outer leg support sections being configured to define a central opening therebetween, a removable center leg support configured for movement between a first position located within the central opening and coupled to the deck to provide a portion of the deck and a second storage position detached from the deck and located in the storage portion of the frame and below the deck, and first and second pivot blocks coupled to the frame, the center leg support including a bottom support surface configured to engage the pivot blocks and hold the center leg support in the first position, the center leg support further including first and second spaced apart guides located adjacent the bottom support surface, the guides being configured to position the center leg support relative to the first and second pivot blocks, wherein the first and second pivot blocks each include a pin and the center leg support includes a pin-receiving receptacle configured to engage the pins when the center leg support is in the first position.

6. A patient support apparatus comprising:

a base, a frame coupled to the base, the frame including a storage portion, a deck coupled to the frame, the deck including a head section, a seat section and first and second laterally spaced apart outer leg support sections pivotally coupled to the seat section, the seat section and the first and second outer leg support sections pivotally coupled to the seat section being configured to define a central opening therebetween, and a removable center leg support configured for movement between a first position located within the central opening and coupled to the deck and above the frame to provide a portion of the deck and a second storage position detached from the deck and located in the storage portion of the frame and below the deck, wherein the first and second outer leg support sections pivotally coupled to the seat section include means for providing a calf support surface.

7. A patient support apparatus comprising:

a base, a frame coupled to the base, the frame including a first open channel and a second closed channel, the first and second channels being spaced apart and extending along a longitudinal axis of the frame, a deck coupled to the frame, the deck being configured to support a patient, and first and second rollers coupled to the deck, the first roller being located in the first open channel and the second roller being located in the second closed channel to permit longitudinal movement of the deck relative to the frame, wherein the first open channel includes planar top and bottom flanges and the second closed channel includes a planar top flange having a downwardly extending lip and a planar bottom flange having an upwardly extending lip to reduce the tendency of the rollers to bind while the rollers traverse the channels.

8. The apparatus of claim 7, wherein the deck includes a head section, a seat section, and first and second laterally spaced apart outer leg support sections pivotably coupled to the seat section, the seat section and the first and second outer leg sections defining between them a central opening.

9. The apparatus of claim 8, further comprising a removable center leg support configured for movement between a first position located within the central opening and coupled to the deck to provide a portion of the deck and a second storage position detached from the deck and located on the frame and below the deck.

10. The apparatus of claim 7, further comprising a latch coupled between the deck and the frame, the latch being movable between a latched position to prevent movement of the deck relative to the frame and an unlatched position to allow longitudinal movement of the deck relative to the frame.

11. The apparatus of claim 10, wherein the latch is movable to a first latched position when the deck is in a first position relative to the frame, the latch also being movable to a second latched position when the deck is moved to a second position relative to the frame.

12. The apparatus of claim 10, further comprising an actuator coupled to the latch to move the latch between the latched and unlatched positions, the actuator being coupled to the deck adjacent a foot end portion of the deck for access by a caregiver while moving the deck toward a foot end of the frame.

13. The apparatus of claim 10, wherein the latch includes a pin coupled to the deck which is configured to enter a receptacle formed in the frame.

14. The apparatus of claim 7, further comprising a siderail pivotably coupled to the frame by first and second swing arms, and a cam surface coupled to the deck, the cam surface being configured to engage the first swing arm as the deck moves relative to the frame to pivot the siderail outwardly relative to the frame.

15. A patient support apparatus comprising:

a base, a frame coupled to the base, the frame including a first open channel and a second closed channel, the first and second channels being spaced apart and extending along a longitudinal axis of the frame, a deck coupled to the frame, the deck being configured to support a patient, first and second rollers coupled to the deck, the first roller being located in the first open channel and the second roller being located in the second closed channel to permit longitudinal movement of the deck relative to the frame, a latch coupled between the deck and the frame, the latch being movable between a latched position to prevent movement of the deck relative to the frame and an unlatched position to allow longitudinal movement of the deck relative to the frame, an actuator coupled to the latch to move the latch between the latched and unlatched positions, the actuator being coupled to the deck adjacent a foot end portion of the deck for access by a caregiver while moving the deck toward a foot end of the frame, wherein the deck includes a head section, a seat section and first and second laterally spaced outer leg support sections adjacent the seat section, the latch includes first and second latches, each of the first and second latches being movable between a latched position to prevent movement of the deck relative to the frame and an unlatched position to allow longitudinal movement of the deck relative to the frame, and the actuator including a first actuator coupled to the first latch to move the first latch between the latched and unlatched positions and a second actuator coupled to the second latch to move the second latch between the latched and unlatched positions, the first actuator being coupled to the first outer leg section and the second actuator being coupled to the second outer leg section.

16. The apparatus of claim 15, wherein the first and second actuators must both be actuated to release the deck from the frame.

17. A patient support apparatus comprising:

a base, a frame coupled to the base, the frame having a head end and a foot end, a deck coupled to the frame, the deck being movable relative to the frame along a longitudinal axis of the frame toward the foot end of the frame, a latch coupled between the deck and the frame, the latch movable between a latched position to prevent movement of the deck relative to the frame and an unlatched position to allow longitudinal movement of the deck relative to the frame, an actuator operatively coupled to the latch to move the latch between the latched and unlatched positions, the actuator being coupled to the deck adjacent a foot end portion of the deck for access by a caregiver while moving the deck toward the foot end of the frame, wherein the frame includes a first open channel and a second closed channel, the first and second channels being spaced apart and extending along a longitudinal axis of the frame, and first and second rollers coupled to the deck, the first roller being located in the first open channel and the second roller being located in the second closed channel to permit longitudinal movement of the deck relative to the frame.

18. A patient support apparatus comprising:

a base, a frame coupled to the base, the frame including a storage portion, a deck coupled to the frame, the deck including a head section, a seat section and first and second laterally spaced apart outer leg support sections adjacent the seat section, the seat section and the first and second leg support sections being configured to define a central opening therebetween, a removable center leg support configured for movement between a first position located within the central opening and coupled to the deck and above the frame to provide a portion of the deck and a second storage position detached from the deck and located in the storage portion of the frame and below the deck, and at least one pivot block non-movably coupled to the frame, the pivot block non-movably coupled to the frame being configured to support the center leg support in the first position located within the central opening and coupled to the deck, wherein the center leg support includes a bottom having a support surface and at least one guide surface cooperating with the at least one pivot block non-movably coupled to the frame to align and hold the center leg support in the first position located within the central opening and coupled to the deck.

19. A patient support apparatus comprising:

a base, a frame coupled to the base, the frame including a storage portion, a deck coupled to the frame, the deck including a head section, a seat section and first and second laterally spaced apart outer leg support sections pivotally coupled to the seat section, the seat section and the first and second outer leg support sections pivotally coupled to the seat section being configured to define a central opening therebetween, a removable center leg support configured for movement between a first position located within the central opening and coupled to the deck and above the frame to provide a portion of the deck and a second storage position detached from the deck and located in the storage portion of the frame and below the deck, and at least one pivot block coupled to the frame, the pivot block being configured to support the center leg support in the first position, wherein the center leg support includes a bottom having a support surface and at least one guide surface cooperating with the at least one pivot block to align and hold the center leg support in the first position.

20. A patient support apparatus comprising:

a base, a frame coupled to the base, the frame including a first open channel and a second closed channel, the first and second channels being spaced apart and extending along a longitudinal axis of the frame, a deck coupled to the frame, the deck being configured to support a patient, and first and second rollers coupled to the deck, the first roller being located in the first open channel and the second roller being located in the second closed channel to permit longitudinal movement of deck relative to the frame, wherein the first open channel includes a planar top and bottom flanges and the second closed channel includes planar top and bottom flanges, at least one of which has a lip portion forming a closed channel so that the tendency of the rollers to bind while the rollers traverse the channels is reduced.

* * * * *